US006751489B2

(12) United States Patent
Shen

(10) Patent No.: US 6,751,489 B2
(45) Date of Patent: Jun. 15, 2004

(54) HIGH TEMPERATURE SUPERCONDUCTOR MINI-FILTERS AND MINI-MULTIPLEXERS WITH SELF-RESONANT SPIRAL RESONATORS

(75) Inventor: Zhi-Yuan Shen, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/051,912

(22) Filed: Jan. 17, 2002

(65) Prior Publication Data

US 2002/0068682 A1 Jun. 6, 2002

Related U.S. Application Data

(63) Continuation of application No. 09/592,466, filed on Jun. 9, 2000, now Pat. No. 6,370,404, and a continuation of application No. 09/079,467, filed on May 15, 1998, now Pat. No. 6,108,569.

(51) Int. Cl.[7] ..... H01P 1/213; H01P 1/203; H01P 12/02

(52) U.S. Cl. ..... 505/210; 333/99.005; 333/204; 333/134; 333/185; 505/700; 505/701; 505/866

(58) Field of Search ..... 333/175, 185, 333/134, 204, 219; 505/210, 700, 701, 705, 866; 336/DIG. 1, 200

(56) References Cited

U.S. PATENT DOCUMENTS 4,851,797 A * 7/1989 Nakamura ..... 333/204 X
4,930,215 A * 6/1990 Roche et al. ..... 29/830
4,999,597 A 3/1991 Gaynor ..... 333/246
5,506,551 A 4/1996 Kaneko et al. ..... 333/207
5,786,303 A * 7/1998 Mansour ..... 333/995 X
5,844,451 A * 12/1998 Murphy ..... 333/185
6,108,569 A * 8/2000 Shen ..... 333/219 X
6,370,404 B1 * 4/2002 Shen ..... 333/995 X

OTHER PUBLICATIONS

Ingo Wolff and Hartmut Kapusta, Modeling of Circular Spiral Inductors for MMICs, *IEEE MTT–S Digest*, 1, 123–126, 1987.

Ewald Pettenpaul, et al., CAD Models of Lumpted Elements on GaAs up to 18 GHz, *IEEE Transactions on Microwave Theory and Techniques*, 36, 294–304, Feb. 1988.

V.A. Galkin, A Miniature Strip Filter Based on Plane Spirals, *Telecommunications and Radio Engineering*, 45, 82–84, Jun. 1990.

Raafat R. Mansour, Design of Superconductive Multiplexers Using Single–Mode and Dual–Mode Filters, *IEEE Transactions on Microwave Theory and Techniques*, 42, 1411–1418, Jul. 1994.

PCT International Search Report dated Nov. 24, 1999 for PCT/US99/10355.

Chen, High–Temperature superconducting dual–spiral resonators and their application in filter miniaturization, Sputercond. Sci. Technol. 13 (2000) 368–372, Singapore.

* cited by examiner

*Primary Examiner*—Benny T. Lee

(57) ABSTRACT

High temperature superconductor mini-filters and mini-multiplexers utilize self-resonant spiral resonators and have very small size and very low cross-talk between adjacent channels.

22 Claims, 18 Drawing Sheets

FREQUENCY $S_{22}$

HIGH TEMPERATURE SUPERCONDUCTOR MINI-FILTERS AND MINI-MULTIPLEXERS WITH SELF-RESONANT SPIRAL RESONATORS

CROSS-REFERENCE TO RELATED APPLICATION

This application is a continuation of application Ser. No. 09/592,466, filed Jun. 9, 2000, now U.S. Pat. No. 6,370,404 (which is incorporated as a part hereof as fully as if set forth at length herein), which is a continuation of application Ser. No. 09/079,467, filed May 15, 1998, now U.S. Pat. No. 6,108,569.

BACKGROUND OF THE INVENTION

This invention relates to high temperature superconductor (HTS) mini-filters and mini-multiplexers with self-resonant spiral resonators as the building blocks, which have the advantages of very small size and very low cross-talk between adjacent filters.

HTS filters have the advantages of extremely low in-band insertion loss, high off-band rejection, steep skirts, due to extremely low loss in the HTS materials. The HTS filters have many applications in telecommunication, instrumentation and military equipment. However, for the regular design of a HTS filter, the resonators as its building blocks are large in size. In fact, at least one dimension of the resonator is equal to approximately a half wavelength. For low frequency HTS filters with many poles, the regular design requires a very large substrate area. The substrates of thin film HTS circuits are special single crystal dielectric materials with high cost. Moreover, the HTS thin film coated substrates are even more costly. Therefore, for saving material cost, it is desirable to reduce the HTS filter size without sacrificing its performance. Furthermore, for the HTS filter circuits, the cooling power, the cooling time, and the cost to cool it down to operating cryogenic temperature increases with increasing circuits' size. These are the reasons to reduce the HTS filter size without sacrificing its performance.

There is a prior art design to reduce the HTS filters size, i.e. by using lumped circuit" elements such as capacitors and inductors to build the resonator used as the building blocks of HTS filters. This approach does reduce the size of HTS filters. However, it also has problems. First, the regular element inductors such as the spiral inductors shown in FIGS. 1*a* and 1*b* have wide spread magnetic fields, which reach the region far beyond the inductor and undesirable cross-talk between adjacent circuits. Second, in the lumped circuit filter design, the two ends of the spiral inductor must be connected to other circuit components such as capacitors etc. But one of the inductor's two ends is located at the center of the spiral, which cannot be directly connected to other components. In order to make the connection from the center end of the spiral inductor to another component, an air-bridge or multi-layer over-pass must be fabricated on top of the HTS spiral inductor. They not only degrade the performance of the filter, but also are difficult to fabricate. Third, there are two ways to introduce lumped capacitors: One is using a "drop-in" capacitor, which usually has unacceptable very large tolerance. The other is using a planar interdigital capacitor, which requires a very narrow gap between two electrodes with high rf voltage across them, which may cause arcing.

The purpose of this invention is to use self-resonant spiral resonators to reduce the size of HTS filters and at the same time to solve the cross-talk and connection problems.

SUMMARY OF THE INVENTION

One embodiment of the invention is a self-resonating spiral resonator including a high temperature superconductor line oriented in a spiral fashion such that adjacent lines are spaced from each other by a gap distance which is less than the line width; and wherein a central opening in the resonator has a dimension approximately equal to that of the gap distance in each dimension.

Another embodiment of the invention is a high temperature superconductor mini-filter including a) a substrate having a front side and a back side;

b) at least two self-resonant spiral resonators in intimate contact with the front side of the substrate;

c) at least one inter-resonator coupling mechanism;

d) an input coupling circuit comprising a transmission line with a first end connected to an input connector of the filter and a second end coupled to a first one of the at least two self-resonant spiral resonators;

e) an output coupling circuit comprising a transmission line with a first end connected to an output connector of the filter and a second end coupled to a last one of the at least two self-resonant spiral resonators;

f) a blank high temperature superconductor film disposed on the back side of the substrate as a ground plane; and g) a blank gold film disposed on the blank high temperature superconductor film.

In another embodiment of the invention, the mini-filters have a strip line form and further include:

a) a superstrate having a front side and a back side, wherein the front side of the superstrate is positioned in intimate contact with the at least two resonators disposed on the front side of the substrate;

b) a second blank high temperature superconductor film disposed at the back side of the superstrate as a ground plane; and c) a second blank gold film disposed on the surface of said second high temperature superconductor film.

A further embodiment of the invention is a mini-multiplexer including at least two of the mini-filters with different and non-overlapping frequency bands; a distribution network with one common port as an input for the mini-multiplexer and multiple distributing ports, wherein one distributing port is connected to a corresponding input of one mini-filter; and a multiple of output lines, wherein each output line is connected to a corresponding output of one mini-filter.

A further embodiment of the invention is a high temperature superconductor mini-filter including:

(a) a substrate having a front side and a back side;

(b) at least two self-resonant spiral resonators in intimate contact with the front side of the substrate, each of said resonators independently comprising a high temperature superconductor line oriented in a spiral fashion (i) such that adjacent lines are spaced from each other by a gap distance which is less than the line width; and (ii) so as to form a central opening within the spiral, the dimensions of which are approximately equal to the gap distance;

(c) at least one inter-resonator coupling;

(d) an input coupling circuit comprising a transmission line with a first end connected to an input connector of the filter and a second end coupled to a first one of the at least two self-resonant spiral resonators;

(e) an output coupling circuit comprising a transmission line with a first end connected to an output connector of the filter and a second end coupled to a last one of the at least two self-resonant spiral resonators;

(f) a blank high temperature superconductor film disposed on the back side of the substrate as a ground plane;

(g) a film disposed on the blank high temperature superconductor film as the contact to a case for said mini-filter;

(h) a superstrate having a front side and a back side, wherein the front side of the superstrate is positioned in intimate contact with the at least two resonators disposed on the front side of the substrate;

(i) a second blank high temperature superconductor film disposed at the back side of the superstrate as a ground plane; and (j) a second film disposed on the surface of said second high temperature superconductor film as a contact to a case for said mini-filter.

A further embodiment of the invention is a high temperature superconductor mini-multiplexer including:

(a) at least two mini-filters, each mini-filter having a frequency band which is different from and does not overlap with the frequency bands of each other mini-filter;

(b) a distribution network with one common port as an input for the mini-multiplexer and multiple distributing ports, wherein one distributing port is connected to a corresponding input of one mini-filter; and (c) a multiple of output lines, wherein one output line is connected to a corresponding output of one mini-filter;

wherein each of said at least two mini-filters comprises:

(d) a substrate having a front side and a back side;

(e) at least two self-resonant spiral resonators in intimate contact with the front side of the substrate, each of said resonators independently comprising a high temperature superconductor line oriented in a spiral fashion (i) such that adjacent lines are spaced from each other by a gap distance which is less than the line width; and (ii) so as to form a central opening within the spiral, the dimensions of which are approximately equal to the gap distance;

(f) at least one inter-resonator coupling;

(g) an input coupling circuit comprising a transmission line with a first end connected to an input connector of the filter and a second end coupled to a first one of the at least two self-resonant spiral resonators;

(h) an output coupling circuit comprising a transmission line with a first end connected to an output connector of the filter and a second end coupled to a last one of the at least two self-resonant spiral resonators;

(i) a blank high temperature superconductor film disposed on the back side of the substrate as a ground plane; and (j) a film disposed on the blank high temperature superconductor film as the contact to a case for said mini-filter.

These and other aspects of the invention and the preferred embodiments will become apparent on a further reading of the specification and claims.

BRIEF DESCRIPTION OF THE DRAWINGS

FIG. 1 shows the prior art conventional spiral inductors, in which

FIG. 2 shows the present self-resonant spiral resonators in different forms.

FIG. 3 shows a first embodiment of the present invention of a microstrip line 4-pole HTS mini-filter with self-resonant rectangular spiral resonators with rounded corners, center tuning pads, and parallel lines input/output coupling circuits. FIG. 3*b* and FIG. 3*c* show, respectively, the end view and side view thereof.

FIG. 4 shows a second embodiment of the present invention of a microstrip line 4-pole HTS mini-filter with self-resonant rectangular spiral resonators, transverse offset inter-resonator coupling adjustment, and inserted line input and output coupling circuits. FIG. 4*a* shows the front view thereof, and FIG. 4*b* and FIG. 4*c* show, respectively, the end view and side view thereof.

FIG. 5 shows a third embodiment of the present invention of a microstrip line 4-pole HTS mini-filter with self-resonant octagon spiral resonators, transverse offset inter-resonator coupling adjustment, and inserted line coupling input and output circuits. FIG. 5*b* and FIG. 5*c* show, respectively, the end view and side view thereof.

FIG. 6 shows a fourth embodiment of the present invention of a microstrip line 4-pole HTS mini-filter with self-resonant circular spiral resonators, circular center tuning pads, and parallel lines input/output coupling circuits. FIG. 6*b* and FIG. 6*c* show, respectively, the end view and side view thereof.

FIG. 7 shows a fifth embodiment of the present invention of a microstrip line 5-pole HTS mini-filter with four self-resonant rectangular spiral resonators, one symmetrical double spiral resonator, and inserted line input and output coupling circuits. FIG. 7*b* and FIG. 7*c* show, respectively, the end view and side view thereof.

FIG. 8 shows a first embodiment of the present invention of a microstrip line mini-multiplexer with two channels. Each channel comprises an 8-pole HTS mini-filter with self-resonant rectangular spiral resonators, and parallel lines input/output coupling circuits. The input circuit of the multiplexer is in the binary splitter form. FIG. 8*a* shows the front view thereof, and FIG. 8*b* and FIG. 8*c* show, respectively, the end view and side view thereof.

FIG. 9 shows a second embodiment of the present invention of a microstrip line mini-multiplexer with four channels. Each channel comprises an 8-pole HTS mini-filter with self-resonant rectangular spiral resonators, and parallel lines input/output coupling circuits. The input circuit of the multiplexer is in the cascaded binary splitter form. FIG. 9*b* and FIG. 9*c* show, respectively, the end view and side view thereof.

FIG. 10 shows a third embodiment of the present invention of a microstrip line mini-multiplexer with four channels. Each channel comprises an 8-pole HTS mini-filter with self-resonant rectangular spiral resonators, and parallel lines input/output coupling circuits. The input circuit of the multiplexer is in the multi-branch line form. FIG. 10*b* and FIG. 10*c* show, respectively, the end view and side view thereof.

11*a* shows the front view thereof.

FIG. 13 shows the measured S-parameters data of the mini-filter shown in FIG. 12, in which

DETAILED DESCRIPTION OF THE PREFERRED EMBODIMENTS

Figure 1A:
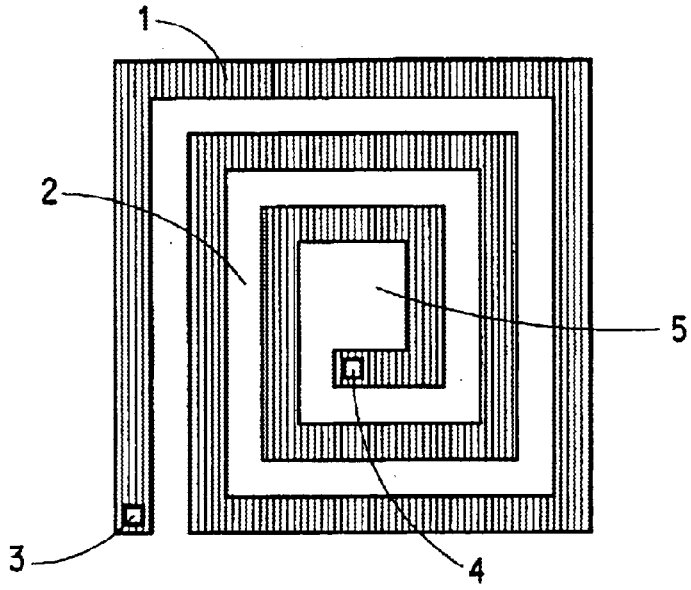
FIG. 1A (PRIOR ART)
FIG. 1*a* shows a prior-art square spiral inductor and FIG. 1*b* shows a prior-art circular spiral inductor.

The present invention provides for reducing the size of HTS filters without sacrificing performance and is based upon the use of self-resonant spiral resonators. The self-resonant spiral resonators have different shapes, including rectangular, rectangular with rounded corners, polygon and circular.

In order to reduce the size of the self-resonant spiral resonator and to confine its electromagnetic fields for minimizing the cross-talk, it is preferred to reduce the width of the gap between adjacent lines and reduce the center open area in the spiral resonator.

There are several methods to change the resonant frequency of the self-resonant spiral resonator: 1. Change the length of the spiral line; 2. Change the gap width between the adjacent lines of the spiral; 3. Place a conductive tuning pad at the center of the spiral. The third method can be used as fine frequency tuning.

The input and output coupling circuits of the mini-filter have two basic configurations: 1. Parallel lines configuration, which comprises a transmission line with one end connected to the mini-filter's connector via a gold pad on top of the line, the other end of the line is extended to be close by and in parallel with the spiral line of the first resonator (for the input circuit) or the last resonator (for the output circuit) to provide the input or output couplings for the filter; 2. Inserted line configuration, it comprises a transmission line with one end connected to the mini-filter's connector via a gold pad on top of the line, the other end of the line is extended to be inserted into the split spiral line of the first resonator (for the input circuit) or the last resonator (for the output circuit) to provide the input or output couplings for the filter.

The inter-resonator couplings between adjacent resonators in the mini-filter are provided by the overlapping of the electromagnetic fields at the edges of the adjacent resonators. The coupling strength can be adjusted by three ways: 1. Change the longitudinal distance between adjacent spiral resonators; 2. Change the orientation of the spiral resonators; 3. Shift the spiral resonator's location along the transverse direction. The third way can be used as coupling strength fine adjustment.

The mini-filters of this invention can be used to build mini-multiplexers, which have very small size without sacrificing performance. The mini-multiplexer comprises at least two channels with two mini-filters having slightly different non-overlapping frequency bands, an input distribution network, and an output port for each channel. The input distribution network has three different configurations: 1. Single binary splitter for the 2-channel mini-multiplexer, which uses a binary splitter to combine the two inputs of the two channels into a common port serving as the input for the mini-multiplexer; 2. Cascaded binary splitter, which consists of cascaded multiple stages of binary splitters. In an N-stage cascaded distribution network, the $2^N$ output ports can be used for combining $2^N$ channels into a common port serving as the input for the mini-multiplexer; 3. Matched multi-branch lines, which consists of a common port as the input of the mini-multiplexer and a multiple of branch lines connected to each channel. The length and width of these lines must appropriately chosen in such a way to achieve matching at the input and the output of the mini-multiplexer over the entire frequency band of the mini-multiplexer.

The mini-filters and mini-multiplexers of this invention can be in the microstrip line form with one substrate and one ground plane, they also can be in the strip line form with a substrate, a superstrate and two ground planes.

Figure 1B:
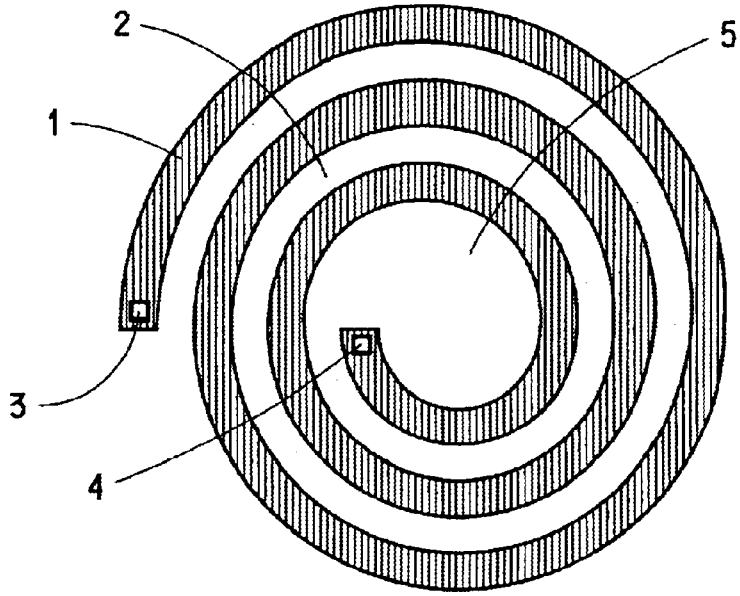
FIG. 1B (PRIOR ART)

The conventional way to make small filters is using lumped circuit design, which utilizes lumped inductance and lumped capacitance to form resonators as the building blocks of the filter. A prior art spiral inductor is shown in FIG. 1, in which FIG. 1*a* shows a rectangular shape and FIG. 1*b* shows a circular shape. Because the structural components of the inductor of FIG. 1*a* is the same as that of FIG. 1*b* (the only difference being the shape or configuration of the spiral), the same reference numerals are used to denote the same structural components. Accordingly, numeral 1 designates the spiral conductor line and numeral 2 is the gap between adjacent turns of conductor line 1. Numerals 3 and 4 are the connecting pads located at the terminal ends of conductor line 1 and numeral 5 is an open area without conductor at the center of the spiral inductor.

The inductors shown in FIG. 1 are used in the conventional design for forming a lumped circuit resonator as the building blocks of a filter. In the prior art conventional design, the dimensions of the lumped inductor must be carefully chosen such that to make its "self-resonant" frequency much higher than the highest frequency in the frequency band of the filter to avoid adverse interference from the self-resonance of the inductor. In order to do so, the gap 2 between adjacent turns should be large compared to the width of conductor line 1, and the center open area 5 should be sufficiently large to let the magnetic fields generated by the current in the spiral line go through. Both measures cause magnetic fields that spread far beyond the spiral inductor and cause cross-talk between adjacent circuits. As mentioned above, the other problem with the conventional design approach is the difficulty of connecting the terminal pad 4 located at the center of the spiral to other circuit components.

The present invention solves the problems by utilizing the self-resonance of these spiral inductors instead of avoiding it. The self-resonance occurs when the operating frequency equals to the self-resonance frequency, $f_S$:

$$f_s=1/\{2\pi[LC_p]^{1/2}\}$$

Here L is the inductance of the spiral, and $C_p$ is the parasitic capacitance between adjacent turns. As mentioned above, for HTS filter design, it is desirable to reduce the size of the filter circuit which requires that the open area of the spiral (numeral 5 in FIGS. 1*a* and 1*b*), as well as the gap (numeral 2 in FIGS. 1*a* and 1*b*) between the conductor lines be minimized. These measures not only reduce the size of the spiral resonator, but also eliminate the need for additional capacitance and the need for center connection. Moreover, these measures also confine most of the electromagnetic fields beneath the spiral resonator, hence solve the cross-talk problem caused by far reaching magnetic fields in the lumped conductor.

Figure 2A:
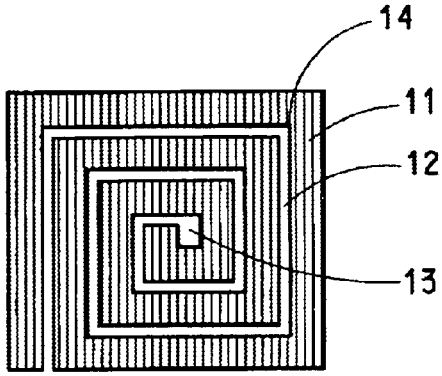
FIG. 2*a* shows a self-resonant spiral resonator in the rectangular form.
Figure 2B:
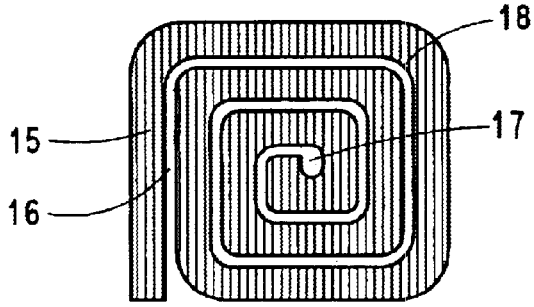
FIG. 2*b* shows a self-resonant spiral resonator in the rectangular form with rounded corners.
Figure 2C:
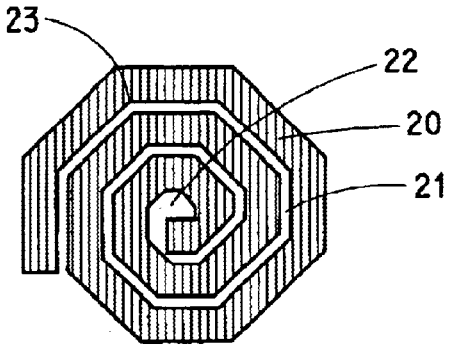
FIG. 2*c* shows a self-resonant spiral resonator in the octagon form.

FIG. 2 shows four embodiments of the self-resonant spiral resonator as follows: rectangular is shown in FIG. 2*a*, a rectangular form with rounded corners is shown in FIG. 2*b*, a polygon shape is shown in FIG. 2*c*, and a circular shape shown in FIG. 2*d*. As seen in FIGS. 2*a*–2*d*, the self-resonant spiral resonators comprise a high temperature superconductor line oriented in a spiral fashion. The adjacent lines that form the spiral are spaced from each other by a gap distance which is less than the width of the line. The central opening in the resonator has a dimension approximately equal to that of the gap distance. It is understood, however, that the gap dimension has only one dimension (i.e., width) whereas the central opening has two dimensions (i.e., length (or height) and width). Accordingly, the phrase "dimension approximately equal to that of the gap distance" means that each dimension of the central opening is approximately the same as the single dimension of the gap distance. It should also be noted from FIGS. 2*a*–2*d* that the central opening is substantially symmetrical and has a shape correspondingly (although not necessarily identical to) the shape of the resonator.

With reference first to FIG. 2*a*, numeral 11 is the conductive line, numeral 12 is the gap between adjacent turns, numeral 13 is the center open area with its dimension close to the width of the reduced gap 12, and numeral 14 indicates the 90-degree sharp corners of the line 11.

The rf electrical charge and current are intended to concentrate at the line corners, which may reduce the power handling capability of the HTS rectangular spiral resonator. To solve the problem, FIG. 2*b* shows a second embodiment of the self-resonant spiral resonator in a rectangular form with rounded corners. In the embodiment of FIG. 2*b*, numeral 15 is the conductive line, numeral 16 is the gap between adjacent turns, numeral 17 is the reduced center open area with its dimension close to the width of the reduced gap 16, and numeral 18 indicates the rounded corners of the line 15.

FIG. 2*c* shows a third embodiment of the self-resonant spiral resonator in a octagon form in which numeral 20 is the conductive line, numeral 21 is the gap between adjacent turns, numeral 22 is the reduced center open area with its dimension close to the width of the reduced gap 21 and numeral 23 indicates the 120-degree corners of the line 20. The self-resonant spiral resonator is not restricted to this particular octagon form. Rather, it can be of any polygon shape, provided that it has more than four corners to distinguish the rectangular shapes.

Figure 2D:
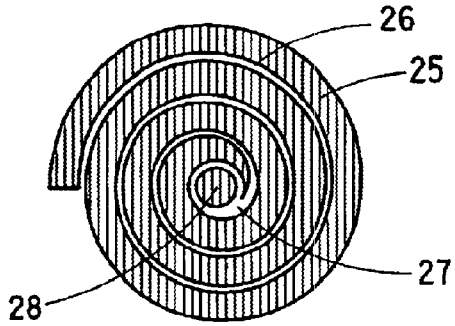
FIG. 2*d* shows a self-resonant spiral resonator in the circular form.

FIG. 2*d* shows a fourth embodiment of the self-resonant spiral resonator in a circular form. In this embodiment, numeral 25 is the conductive line, numeral 26 is the gap between adjacent turns, numeral 27 is the reduced center open area with its dimension close to the width of the reduced gap 26 and numeral 28 is a conductive tuning pad located at the center open area 27 for fine tuning the resonant frequency of the spiral resonator. The tuning pad is not restricted to this specific form of circular shape, but instead may be in rectangular form or any arbitrary forms. It is further to be understood that the tuning pad may be used with any of the other configurations described above and is not restricted in its use to the spiral resonator having the circular configuration.

Figure 3B:
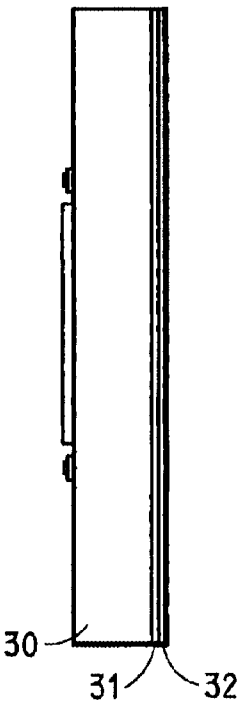
Figure 3A:
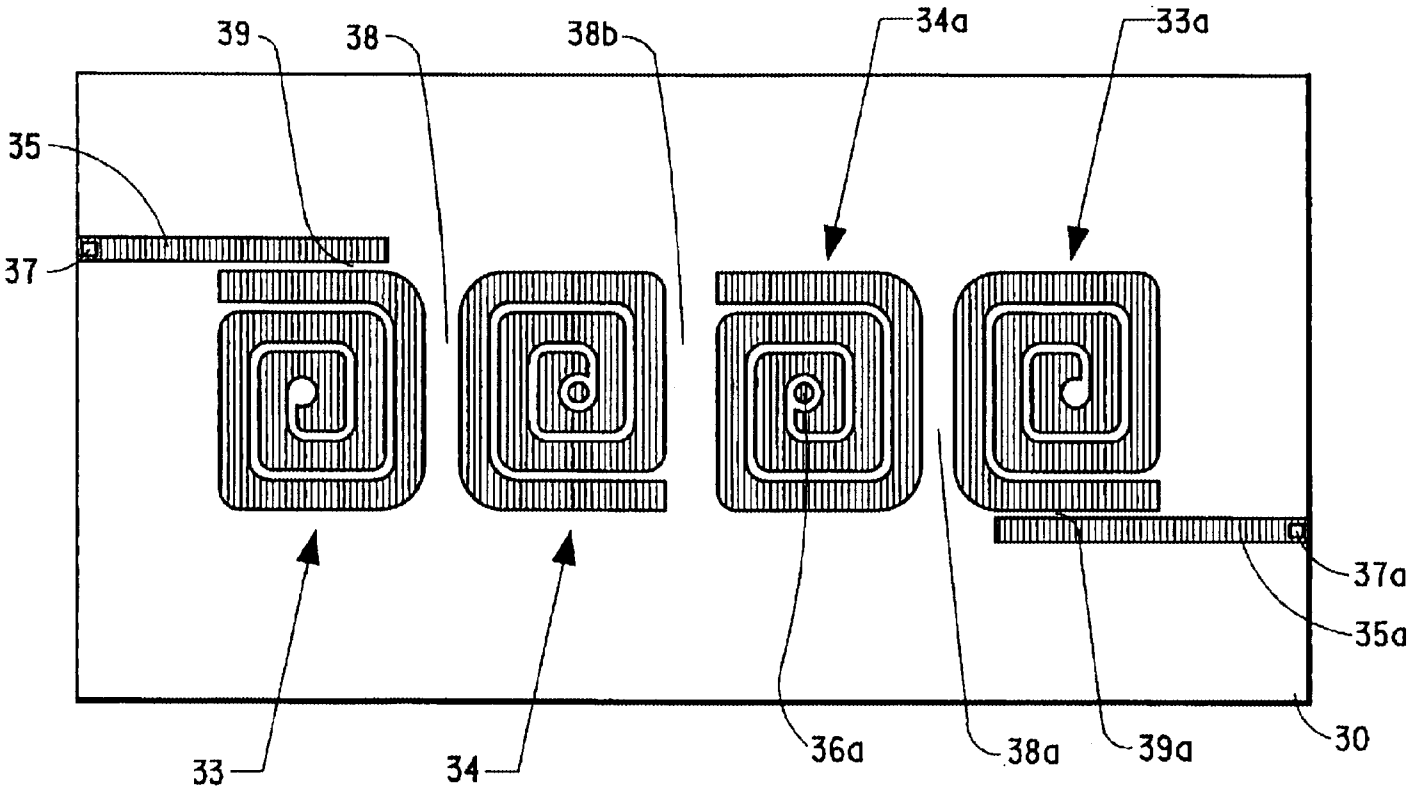
FIG. 3*a* shows the front view thereof.

FIG. 3 shows a first embodiment of the 4-pole HTS mini-filter circuit having four self-resonant spiral resonators (in this case having a rectangular configuration with rounded corners) as its frequency selecting element. FIG. 3*a* shows the top or front view of the filter, FIG. 3*b* shows an end view, and FIG. 3*c* shows a side view. In FIGS. 3*a*, 3*b* and 3*c*, numeral 30 is a dielectric substrate with a front side and a back side. The HTS filter mini-circuit is disposed on the front side of the substrate 30 as shown in FIGS. 3*a*, 3*b* and 3*c*. The back side of the substrate 30 (which is seen in the views of FIG. 3*b* and FIG. 3*c* but is not seen in the view of FIG. 3*a*) is disposed with a blank HTS film 31 (see FIG. 3*b* and FIG. 3*c*) serving as the ground of the mini-filter circuit. A gold film 32 (see FIG. 3*b* and FIG. 3*c*) is disposed on top of HTS film 31 and functions as the contact to the mini-filter's case 32*a*, shown in FIGS. 3*a*, 3*b* and 3*c*. In FIG. 3*a*, numerals 33, 34, 33*a*, and 34*a* are four self-resonant rectangular spiral resonators with rounded corners. The inter-resonator couplings are provided by the coupling gaps, 38, 38*a*, and 38*b*, between the adjacent resonators. The input coupling circuit is in a parallel lines form, which comprises an input line 35 and the coupling gap 39 between 35 and the first resonator 33. The output coupling circuit is in a parallel lines form, which comprises an output line 35*a* and the coupling gap 39*a* between 35*a* and the last resonator 33*a*. Two tuning pads 36, 36*a* are placed at the center of resonators 34 and 34*a*, respectively, for fine tuning the resonant frequency of the resonators 34 and 34*a*. Gold connecting pads 37 and 37*a* are disposed on the input and output line 35 and 35*a*, respectively, providing the connections to the mini-filter's input and output connectors 37*b* and 37*c*, respectively, shown in FIGS. 3*a* and 3*c*.

Figures 4A, 4B:
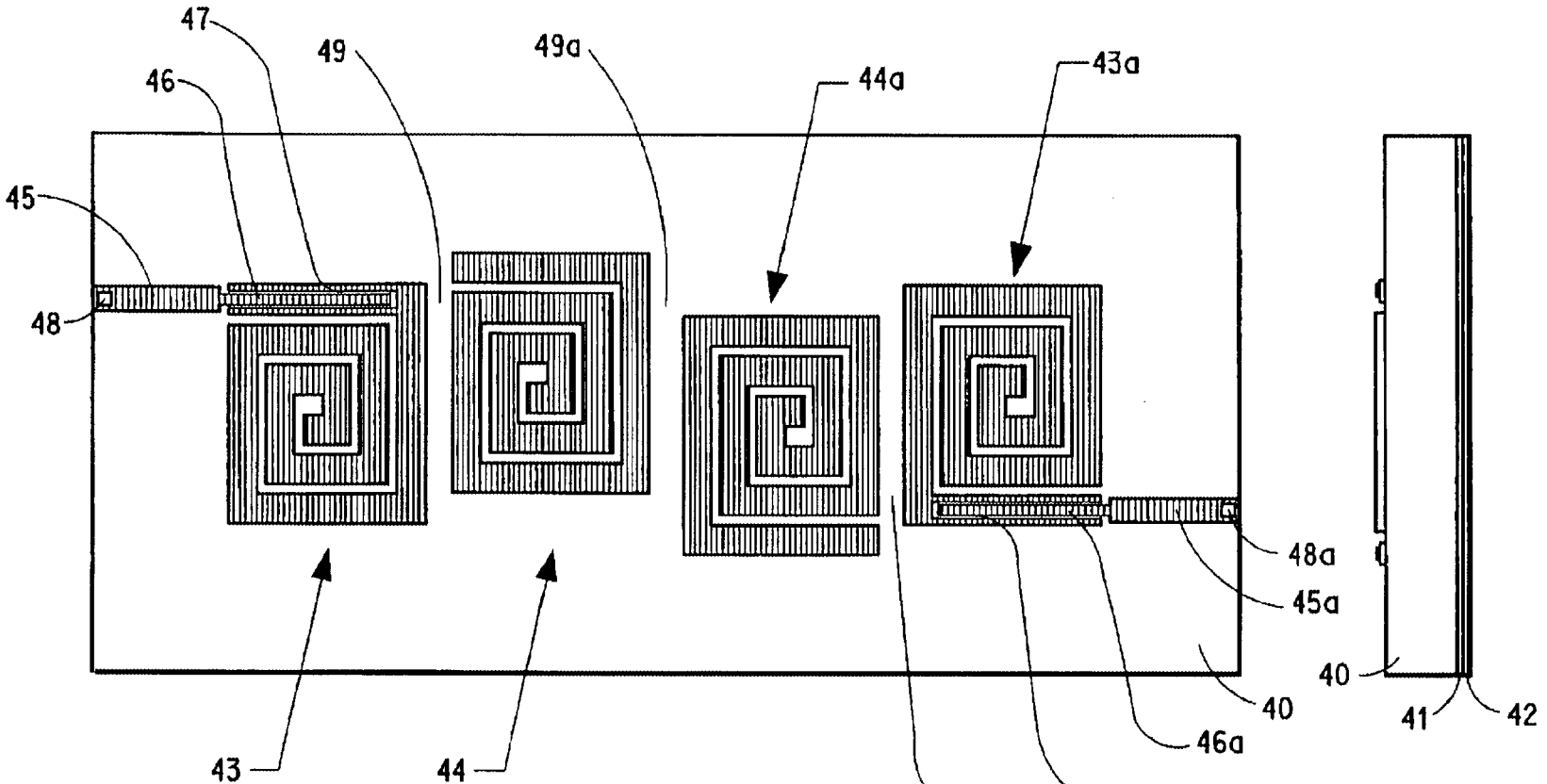

FIG. 4 shows a second embodiment of the 4-pole HTS mini-filter circuit having four self-resonant rectangular spiral resonators as its frequency selecting element, in which FIG. 4*a* shows the top or front view of the filter, FIG. 4*b* shows an end view, and FIG. 4*c* shows a side view. Numeral 40 is a dielectric substrate with a front side and a back side. The FITS mini-filter circuit is disposed on the front side of the substrate 40 as shown in FIGS. 4*a*, 4*b* and 4*c*. As indicated by the views shown in FIGS. 4*b* and 4*c*, the back side of the substrate 40 is disposed with a blank HTS film 41 serving as the ground of the mini-filter circuit, and a gold film 42 is disposed on top of 41 serving as the contact to the mini-filter's case 42*a*, shown in FIGS. 4*a*~4*c*. In FIG. 4*a*, numerals 43, 44, 43*a*, and 44*a* are the four self-resonant rectangular spiral resonators. The inter-resonator couplings are provided by the coupling gaps 49, 49*a*, 49*b* between adjacent resonators. In this particular case, the inter-resonator coupling strength is adjusted by changing the gap width between the adjacent resonators, as well as by shifting the resonator's location in the transverse direction for the fine adjustment. The input coupling circuit is in the inserted line form, which comprises an input line 45 with its extended narrower line 46 inserted into the split spiral line of the first resonator 43 with a coupling gap 47 between them. The output coupling circuit is in the inserted line form, which comprises an output line 45*a* with its extended narrower line 46*a* inserted into the split spiral line of the last resonator 43*a* with a coupling gap 47*a* between them. Gold connecting pads 48 and 48*a* are disposed on the input and output lines 45 and 45*a*, respectively, providing the connections to the mini-filter's input and output connectors 48*b* and 48*c*, respectively, shown in FIGS. 4*a* and 4*c*.

FIG. 5 shows a third embodiment of the 4-pole HTS mini-filter circuit having self-resonant four octagon spiral resonators as its frequency selecting element, in which FIG.

Figure 5B:
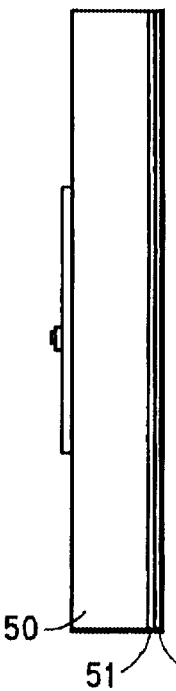
Figure 5A:
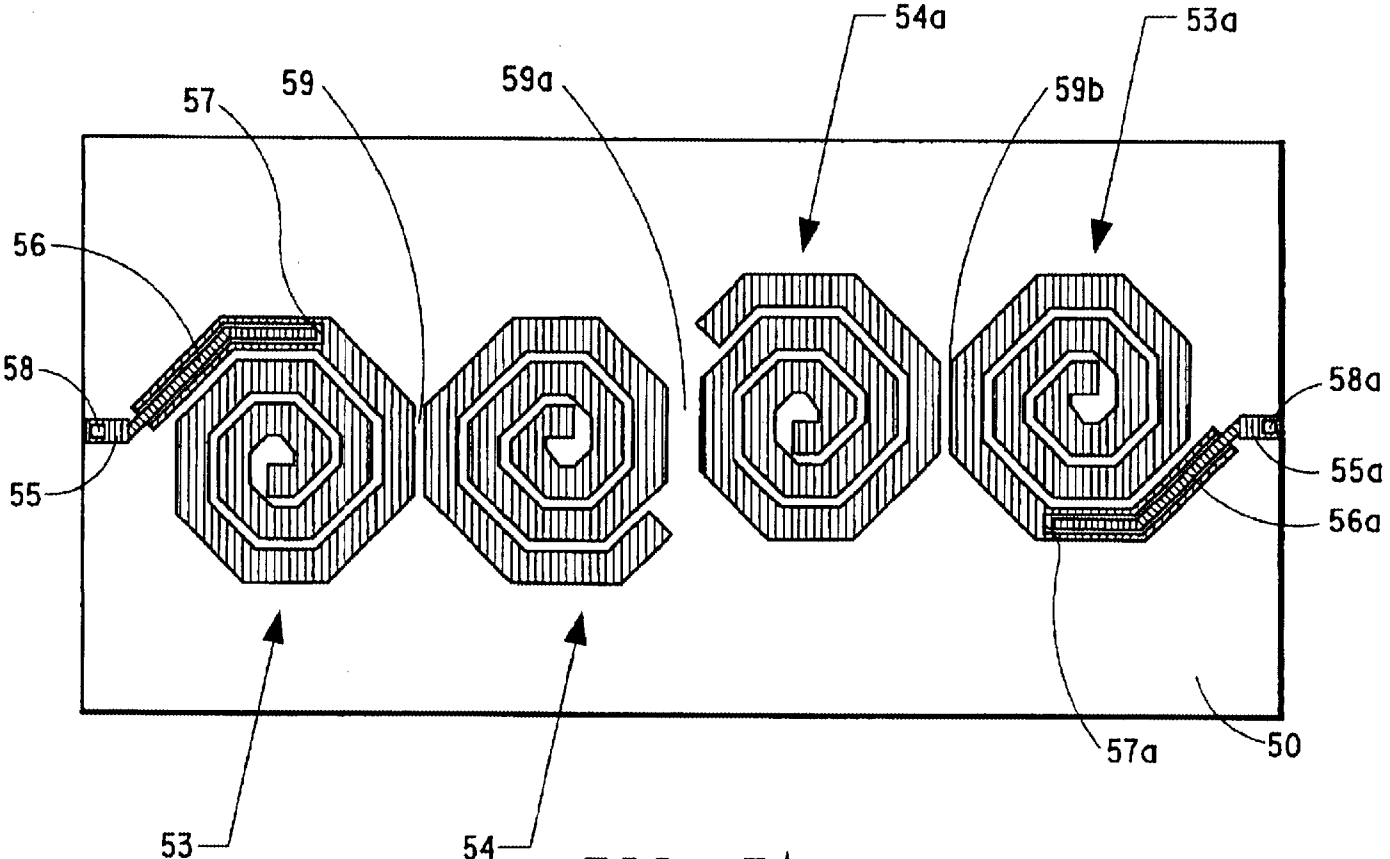
FIG. 5*a* shows the front view thereof.

5*a* shows the top or front view, FIG. 5*b* shows an end view, and FIG. 5*c* shows a side view. Numeral 50 is a dielectric substrate with a front side and a back side. The HTS mini-filter circuit is disposed on the front side of the substrate 50 as shown in FIGS. 5*a*~5*c*. As indicated by the views shown in FIG. 5*b* and FIG. 5*c*, the back side of the substrate 50 is disposed with a blank HTS film 51 serving as the ground of the mini-filter circuit, and a gold film 52 is disposed on top of blank HTS film 51 serving as the contact to the mini-filter's case 52*a*, shown in FIGS. 5*a*~5*c*. In FIG. 5*a*, numerals 53, 54, 53*a*, and 54*a* are the four self-resonant octagon spiral resonators. The inter-resonator couplings are provided by the coupling gaps 59, 59*a*, 59*b*, between adjacent resonators. In this particular case, the inter-resonator coupling strength is adjusted by changing the gap width between the adjacent resonators, as well as by shifting the resonator's location in the transverse direction for the fine adjustment. The input coupling circuit is in the inserted line form, which comprises an input line 55 with its extended line 56 inserted into the split spiral line of the first resonator 53 with a coupling gap 57 between them. The output coupling circuit is in the inserted line form, which comprises an output line 55*a* with its extended line 56*a* inserted into the split spiral line of the last resonator 53*a* with a coupling gap 57*a* between them. Gold connecting pads 58 and 58*a* are disposed on the input and output lines 55 and 55*a*, respectively, providing the connections to the mini-filter's input and output connectors 58*b* and 58*c*, respectively, shown in FIGS. 5*a* and 5*c*.

Figure 6B:
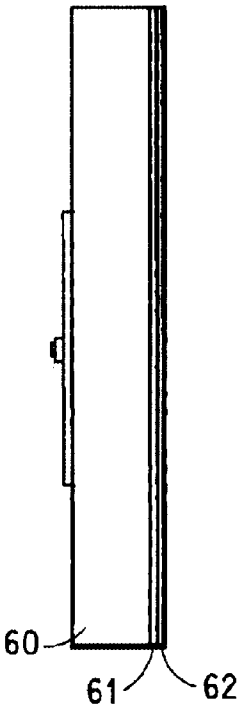
Figure 6A:
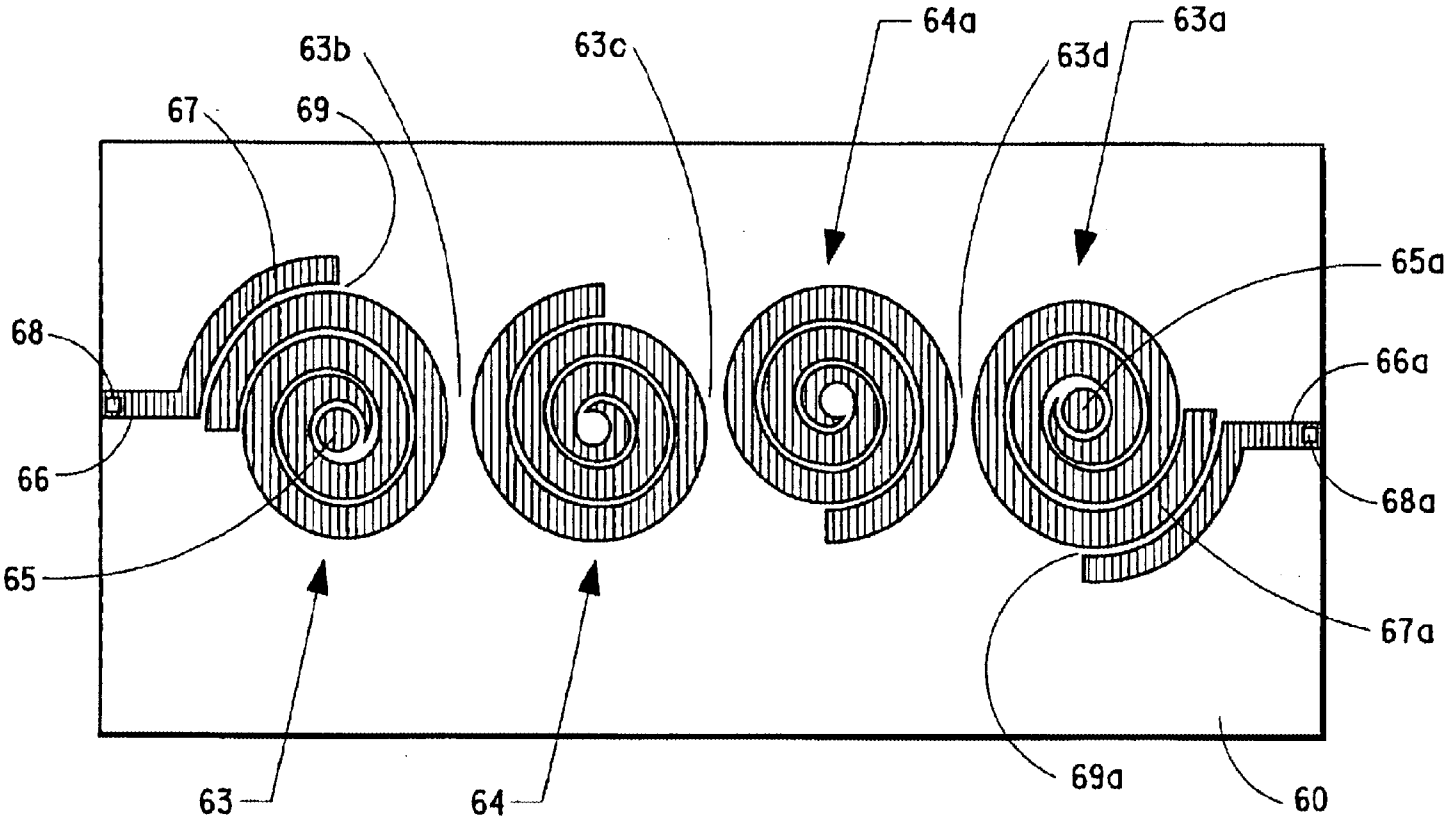
FIG. 6*a* shows the front view thereof.

FIG. 6 shows a fourth embodiment of the 4-pole HTS mini-filter circuit having four self-resonant circular spiral resonators as its frequency selecting element, in which FIG. 6*a* shows the circuit top or front view, FIG. 6*b* shows the end view, and FIG. 6*c* shows the side view. Numeral 60 is a dielectric substrate with a front side and a back side. The HTS mini-filter circuit is disposed on the front side of the substrate 60 as shown in FIGS. 6*a*~6*c*. As indicated by the end view shown in FIG. 6*b* and the side view shown in FIG. 6*c*, the back side of the substrate 60 is disposed with a blank HTS film 61 serving as the ground of the mini-filter circuit, and a gold film 62 is disposed on top of blank HTS film 61 serving as the contact to the mini-filter's case 62*a*, shown in FIGS. 6*a*~6*c*. In FIG. 6*a*, numerals 63, 64, 63*a*, and 64*a* are the four self-resonant circular spiral resonators. The inter-resonator couplings are provided by the coupling gaps 63*b*, 63*c*, 63*d*, between adjacent resonators. The input coupling circuit is in the parallel line form, which comprises an input line 66 and an extended line 67, the input coupling is provided by the gap 69 between 67 and the first resonator 63. The output coupling circuit is in the parallel line form, which comprises an output line 66*a* and an extended line 67*a*, the output coupling is provided by the gap 69*a* between 67 and the first resonator 63. Two tuning pads 65, 65*a* are placed at the center of resonators 63 and 63*a*, respectively for fine tuning the resonant frequency of the resonators 63 and 63*a*. Gold connecting pads 68 and 68*a* are disposed on the input and output lines 66 and 66*a*, respectively, providing the connections to the mini-filter's input and output connectors 68*b* and 68*c*, respectively, shown in FIGS. 6*a* and 6*c*.

Figure 7B:
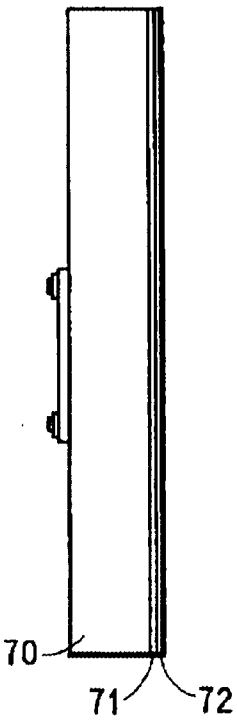
Figure 7A:
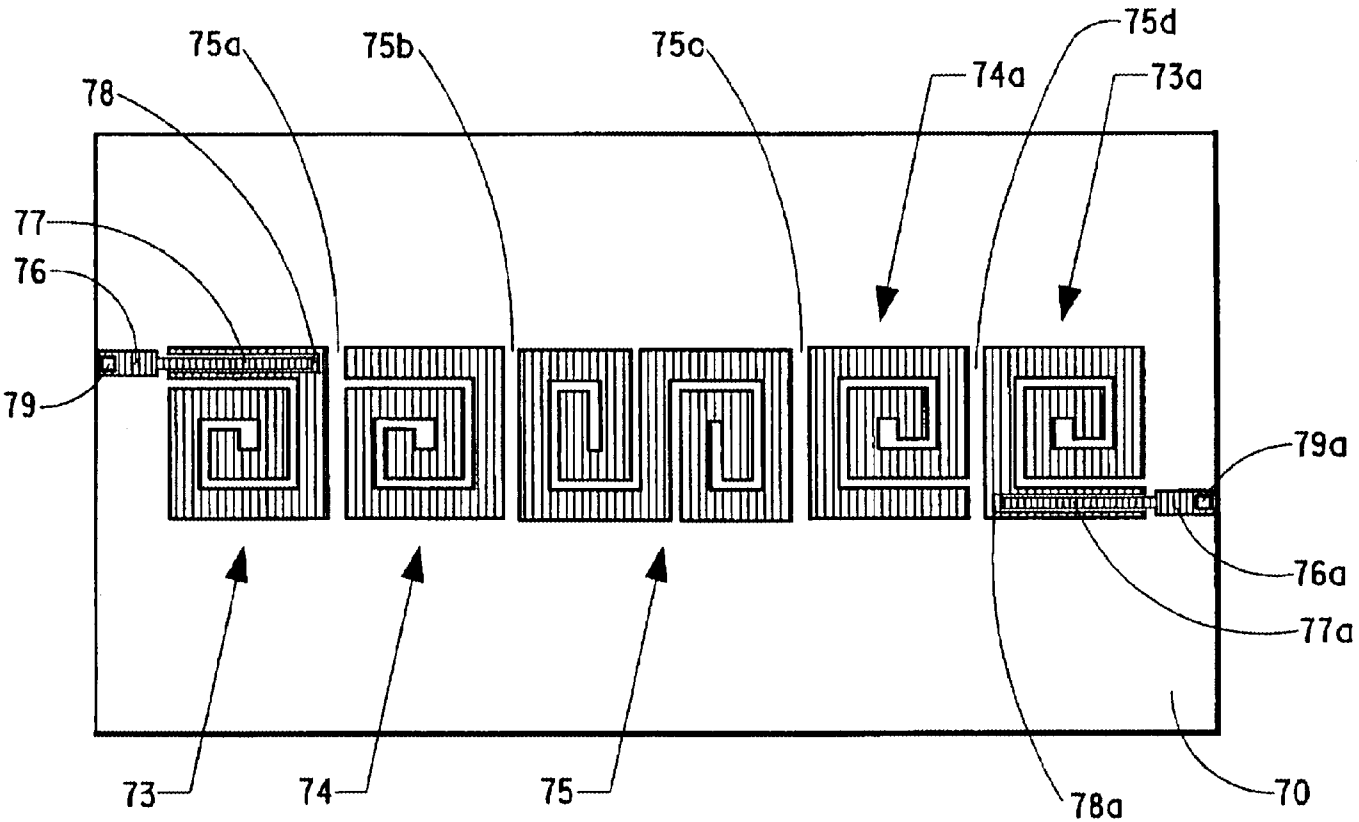
FIG. 7*a* shows the front view thereof.

FIG. 7 shows one embodiment of a 5-pole HTS mini-filter circuit having five self-resonant rectangular spiral resonators as its frequency selecting element, in which FIG. 7*a* shows the circuit top or front view, FIG. 7*b* shows the end view, and FIG. 7*c* shows the side view. Numeral 70 is a dielectric substrate with a front side and a back side. The HTS mini-filter circuit is disposed on the front side of the substrate 70 as shown in FIGS. 7*a*~7*c*. As indicated by the end view shown in FIG. 7*b* and the side view shown in FIG. 7*c*, the back side of the substrate 70 is disposed with a blank HTS film 71 serving as the ground of the mini-filter circuit, and a gold film 72 is disposed on top of blank HTS film 71 serving as the contact to the mini-filter's case 72*a*, shown in FIGS. 7*a*~7*c*. In FIG. 7*a*, numerals 73, 74, 73*a*, and 74*a* are the four self-resonant rectangular single spiral resonators, numeral 75 is a self-resonant rectangular double spiral resonator, which is centrally located and thus serves as the middle resonator. The use of double spiral resonator 75 at the middle of the 5-pole filter is to make the circuit geometry symmetrical with respect to the input and the output. This approach is also suitable for any symmetrical mini-filter with odd number poles. The inter-resonator couplings are provided by the coupling gaps 75*a*, 75*b*, 75*c*, 75*d*, between adjacent resonators. In this particular case, the inter-resonator coupling strength is adjusted by changing the gap width between the adjacent resonators. The input coupling circuit is in an inserted line form, which comprises an input line 76 with its extended narrower line 77 inserted into the split spiral line of first resonator 73 with a coupling gap 78 between them. The output coupling circuit is in a inserted line form, which comprises an output line 76*a* with its extended narrower line 77*a* inserted into the split spiral line of last resonator 73*a* with a coupling gap 78*a* between them. Gold connecting pads 79 and 79*a* are disposed on the input and output lines 76 and 76*a*, respectively, providing the connections to the mini-filter's input and output connectors 79*b* and 79*c*, respectively, shown in FIGS. 7*a* and 7*c*.

Figures 8A, 8B:
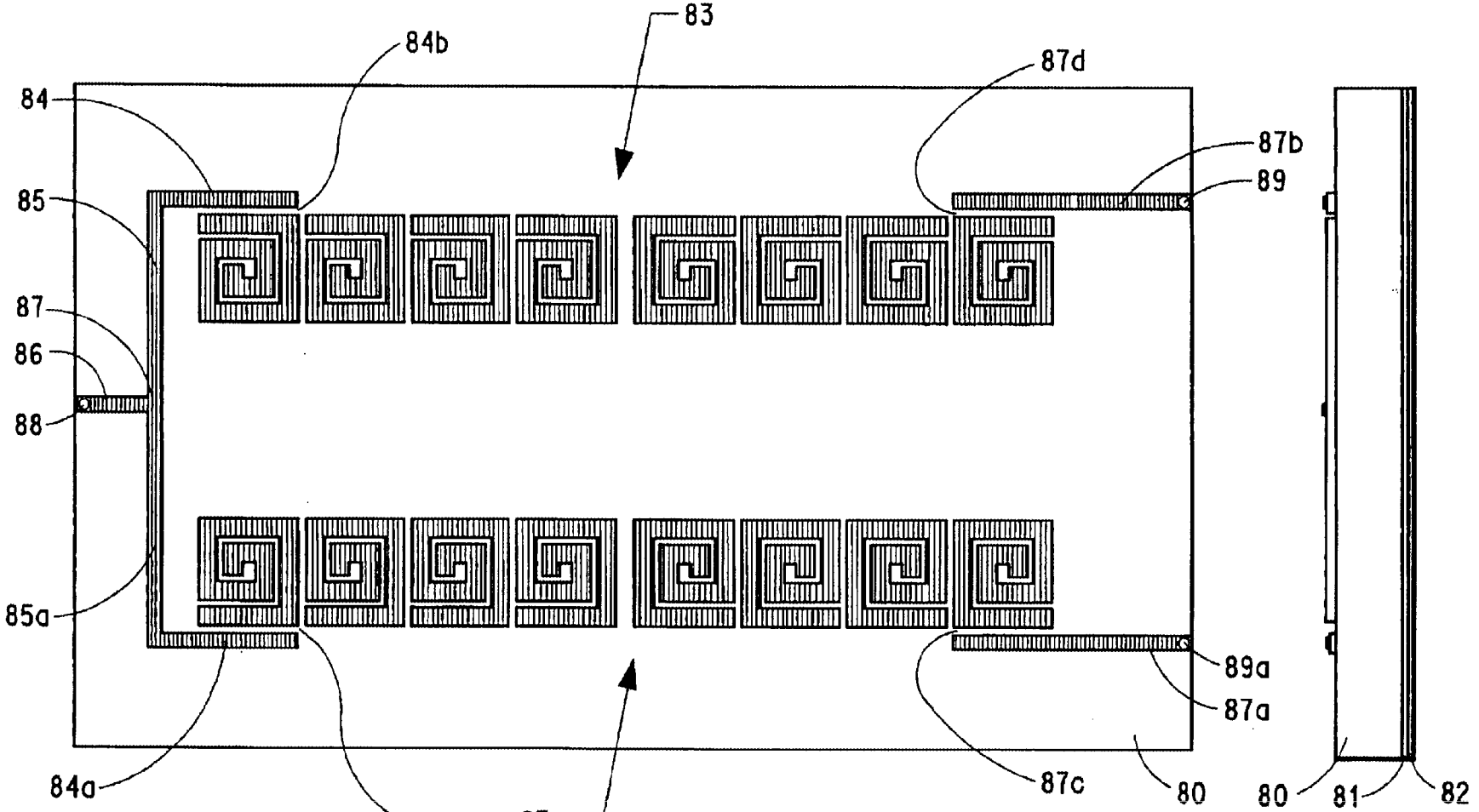

FIG. 8 shows a 2-channel mini-multiplexer, each channel has a 8-pole HTS mini-filter 83, 83*a* (see FIG. 8*a*), respectively, with eight rectangular self-resonant spiral resonators. FIG. 8*a* shows the top or front view, FIG. 8*b* shows the end view, and FIG. 8*c* shows the side view. Numeral 80 is a dielectric substrate with a front side and a back side. The HTS mini-multiplexer circuit is disposed on the front side of substrate 80 as shown in FIGS. 8*a*~8*c*. As indicated by the end view shown in FIG. 8*b* and the side view shown in FIG. 8*c*, the back side of the substrate 80 is disposed with a blank HTS film 81 serving as the ground of the mini-multiplexer circuit, and a gold film 82 is disposed on top of blank HTS film 81 serving as the contact to the mini-multiplexer's case 82*a*, shown in FIGS. 8*a*~8*c*. The frequency bands of mini-filters 83 and 83*a* are slightly different and without overlapping to form two channels. As shown in FIG. 8*a*, the input coupling circuits of mini-filters 83 and 83*a* are in the parallel lines form, which comprise input lines 84 and 84*a* and the gaps 84*b*, 84*c*, respectively, between input lines 84 and 84*a* and the first spiral resonator of filters 83 and 83*a*, respectively. A distribution network in a single binary splitter form serves as the input of the multiplexer, which comprises the common input line 86, a T-junction 87, and branch lines 85 and 85*a*, with one end of each of the branch lines 85 and 85*a* commonly connected to T-junction 87, and the other end thereof connected to coupling lines 84 and 84*a*, respectively. The dimensions of coupling lines 84 and 84*a*, branch lines 85 and 85*a*, common input line 86 and T-junction 87 are selected in such a way to provide the input impedance matching of the mini-multiplexer over the frequency range covering the two frequency bands of filters 83 and 83*a*. The output coupling circuits of filters 83 and 83*a* are in the parallel lines form, which comprise the output lines 87*a* and 87*b*, and the gap 87*c*, 87*d*, respectively, between them and the last resonator of filters 83 or 83*a*. Output lines 87*a* and 87*b* also serve as the output lines for the two channels of the mini-multiplexer. Gold connecting pads 88, 88*a* and 88*b* are disposed on the input line 86, and output lines 87*a* and 87*b*, respectively, providing the connections to the mini-multiplexer's input connector 89 and the two output connectors 89*a* and 89*b*, shown in FIG. 8*a*.

It should be understood that the form of the self-resonant spiral resonators in the mini-multiplexer is not restricted to the rectangular form illustrated in FIG. 8, but rather they can be of any configuration such as shown in FIGS. 2*a*–2*d* or combinations thereof. Further it is to be understood that the form of the input and output coupling circuits of the mini-filters in the mini-multiplexer is not restricted to the parallel line form shown in FIG. 8, but instead other line forms may be used, such as the inserted line form or combinations of inserted line form and parallel line form.

Figure 9B:
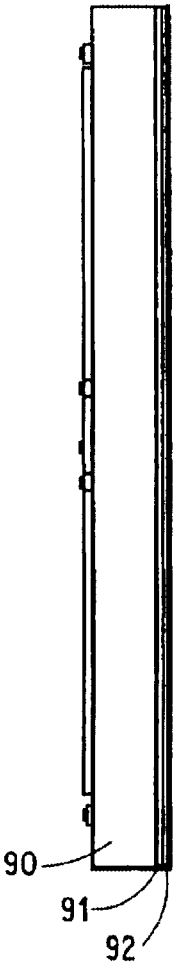
Figure 9A:
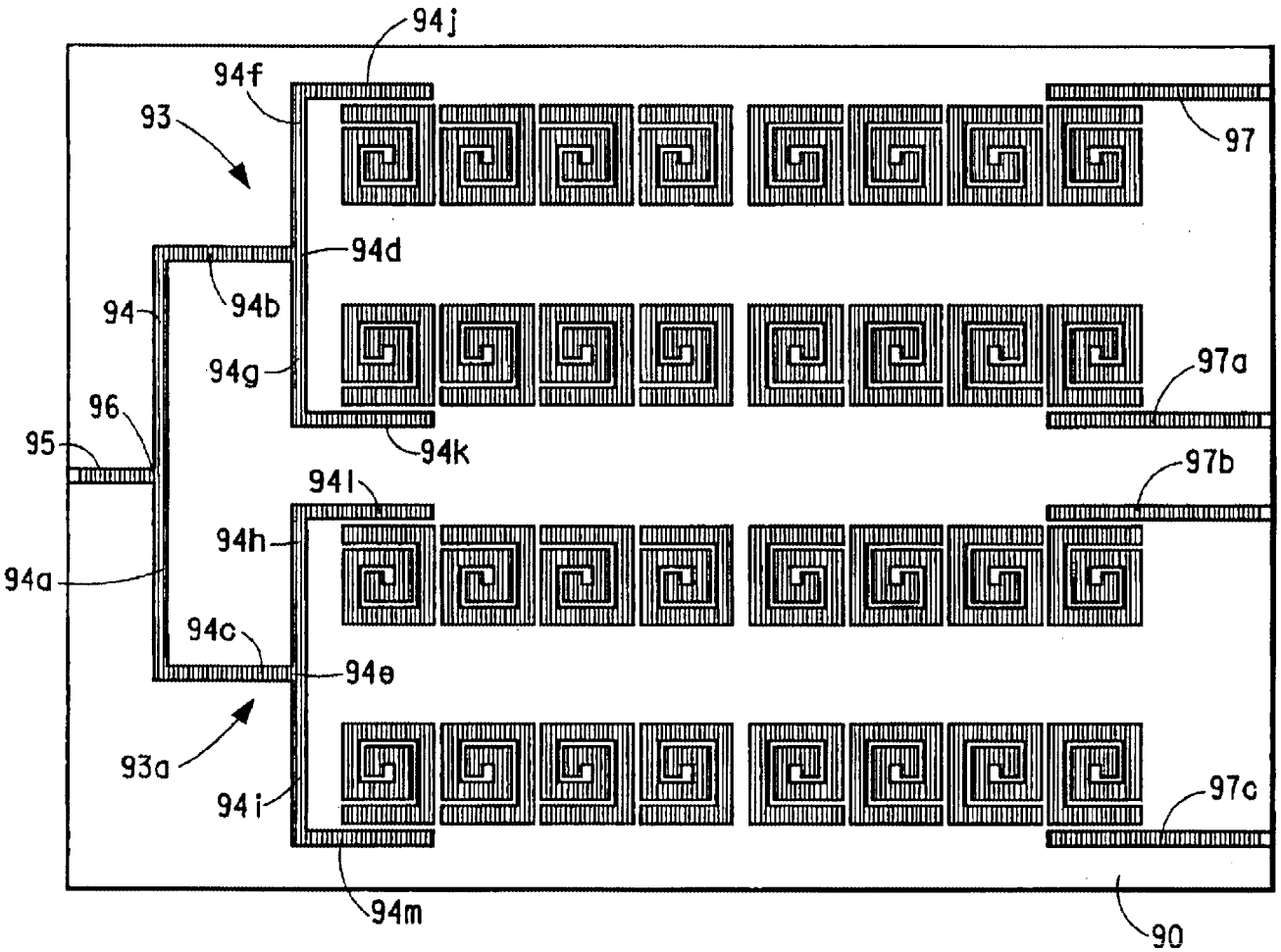
FIG. 9*a* shows the front view thereof.

FIG. 9 shows a second embodiment of the 4-channel mini-multiplexer, each channel having an 8-pole HTS mini-filter with eight self-resonant rectangular spiral resonators, in which FIG. 9*a* shows the top or front view, FIG. 9*b* shows the end view, and FIG. 9*c* shows the side view. Numeral 90 is a dielectric substrate with a front side and a back side. The HTS mini-multiplexer circuit is disposed on the front side of substrate 90 as shown in FIGS. 9*a*–9*c*. As indicated by the end view shown in FIG. 9*b* and the side view shown in FIG. 9*c*, the back side of the substrate 90 is disposed with a blank HTS film 91 serving as the ground of the mini-multiplexer circuit, and a gold film 92 is disposed on top of blank HTS film 91 serving as the contact to the mini-multiplexers case 98 shown in FIGS. 9*a*~9*c*. In FIG. 9*a*, numerals 93 and 93*a* are used to designate two 2-channel mini-multiplexers similar to that shown in FIG. 8. The frequency bands of mini-multiplexers 93 and 93*a* are slightly different and without overlapping. As shown in FIG. 9*a*, the distribution network at the input of the 4-channel mini-multiplexer is in a 2-stage cascaded binary splitter form. The first stage comprises a common input line 95, a T-junction 96 and two branch lines 94 and 94*a*, with one end of each of the branch lines 94 and 94*a* commonly connected to T-junction 96, and the other end thereof connected to the input lines 94*b* and 94*c*, respectively, of the second stage. The second stage comprises two binary splitters, which actually are the input binary splitters of the two 2-channel mini-multiplexers 93 and 93*a*, and comprise input lines 94*b* and 94*c*; T-junctions 94*d* and 94*e*; branch lines 94*f*, 94*g*, 94*h* and 94*i*; and input lines 94*j*, 94*k*, 94*l* and 94*m*, as shown in FIG. 9*a*. The dimensions of mini-multiplexers 93 and 93*a*, branch lines 94 and 94*a*, input lines 94*b* and 94*c*, T-junctions 94*d* and 94*e*, branch lines 94*f*, 94*g*, 94*h* and 94*i*, input lines 94*j*, 94*k*, 94*l* and 94*m*, common input line 95 and T-junction 96 are selected in such a way to provide the input impedance matching of the mini-multiplexer over the frequency range covering the four frequency bands of the 4-channel mini-multiplexer. The output circuits of the 4-channel mini-multiplexer comprise the two 2-channel mini-multiplexers' output lines: 97, 97*a*, 97*b*, 97*c*, which serve as the four output lines for the 4-channel mini-multiplexer as shown in FIG. 9*a*.

Figure 10B:
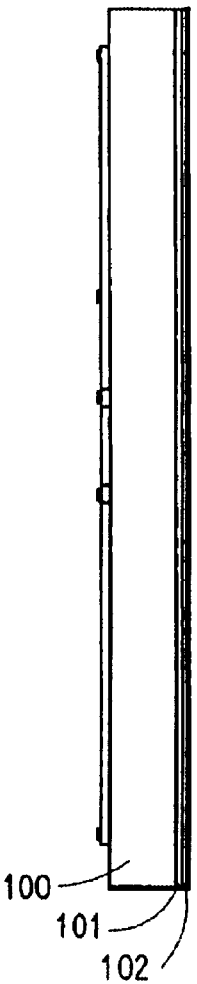
Figure 10A:
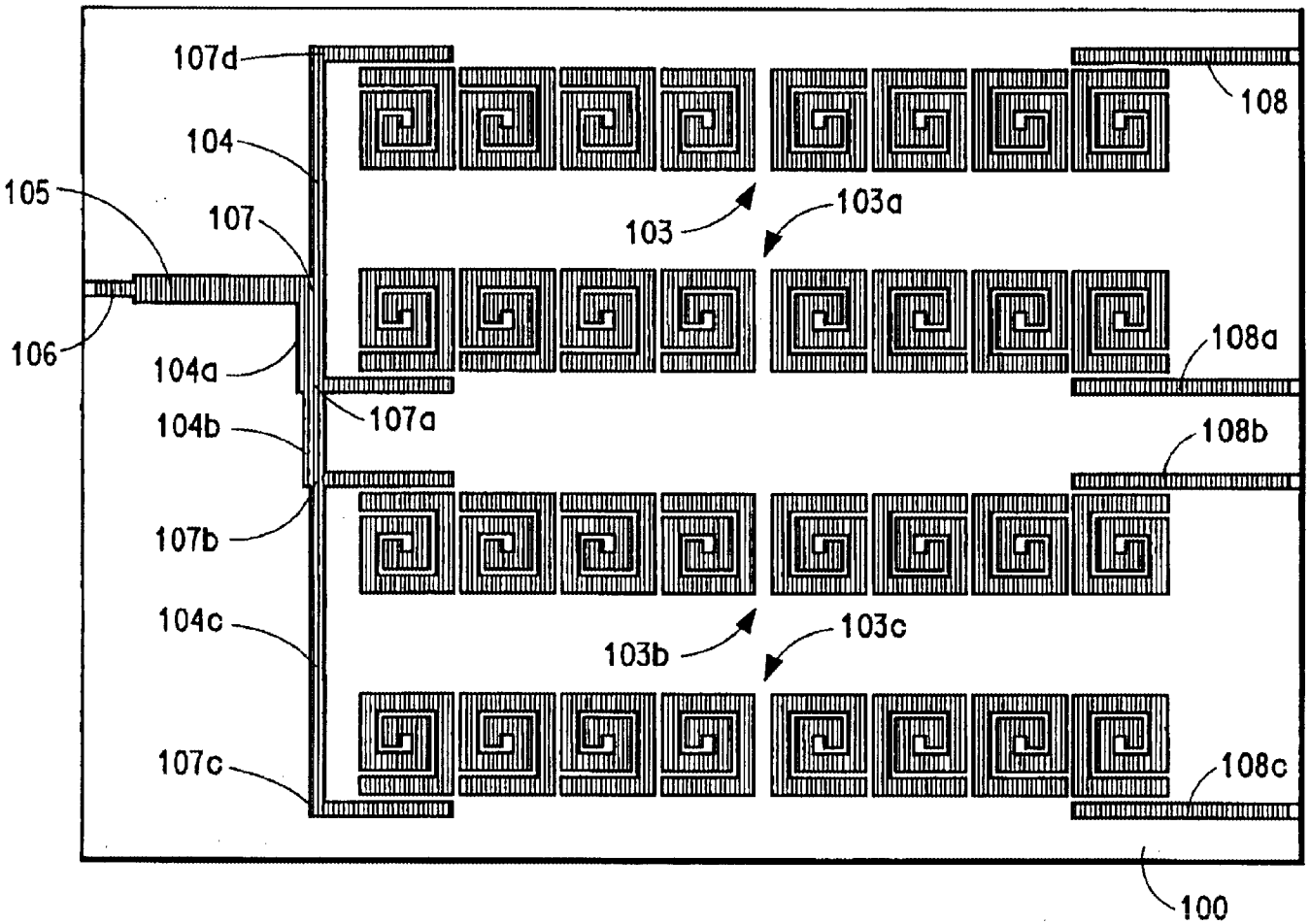
FIG. 10*a* shows the front view thereof.

FIG. 10 shows a third embodiment of the 4-channel mini-multiplexer, each channel comprising an 8-pole HTS mini-filter 103, 103*a*, 103*b*, 103*c* (see FIG. 10*a*), with eight self-resonant rectangular spiral resonators. FIG. 10*a* shows the top or front view, FIG. 10*b* shows the end view, and FIG. 10*c* shows the side view. Numeral 100 is a dielectric substrate with a front side and a back side. The HTS mini-multiplexer circuit is disposed on the front side of substrate 100 as shown in FIGS. 10*a*~10*c*. As indicated by the end view shown in FIG. 10*b* and the side view shown in FIG. 10*c*, the back side of the substrate 100 is disposed with a blank HTS film 101 serving as the ground of the mini-multiplexer circuit, and a gold film 102 is disposed on top of blank HTS film 101 serving as the contact to the mini-multiplexer's case 109, shown in FIGS. 10*a*~10*c*. The frequency bands of filters 103, 103*a*, 103*b*, and 103*c* are slightly different and without overlapping to form four channels. As shown in FIG. 10*a*, the distribution network at the input of the 4-channel mini-multiplexer is in a matched branch lines form, which comprises a common input line 106, a matching section 105, line sections 104, 104*a*, 104*b*, 104*c*, and five junctions: 107, 107*a*, 107*b*, 107*c* and 107*d*. The dimensions of line sections 104, 104*a*, 104*b* and 104*c*, matching section 105, common input line 106, and junctions 107, 107*a*, 107*b*, 107*c* and 107*d*, are selected in such a way to provide the input impedance matching of the mini-multiplexer over the frequency range covering the four frequency bands of the 4-channel mini-multiplexer. The output circuits of the 4-channel mini-multiplexer comprise the four mini-filter's output lines: 108, 108*a*, 108*b*, 108*c*, which serve as the four output lines for the 4-channel mini-multiplexer as shown in FIG. 10*a*.

Figure 11B:
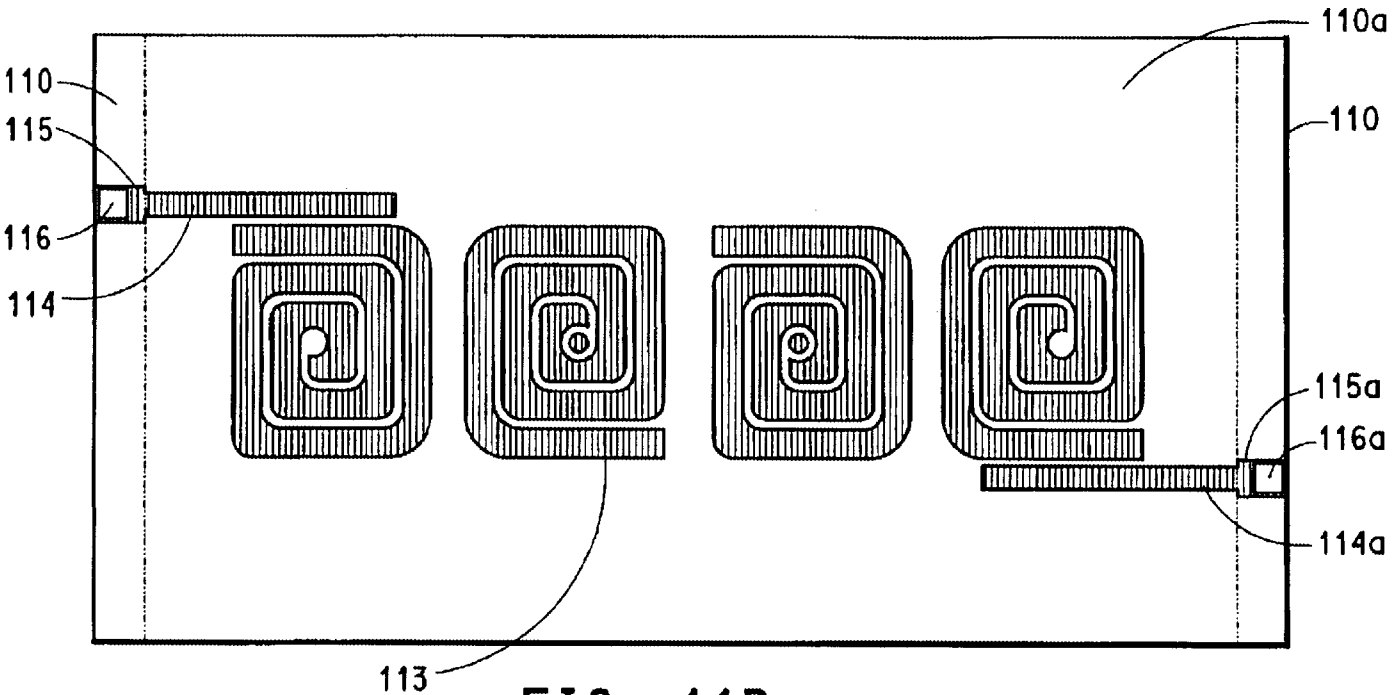
FIG. 11*b* shows the side view thereof.
Figure 11A:
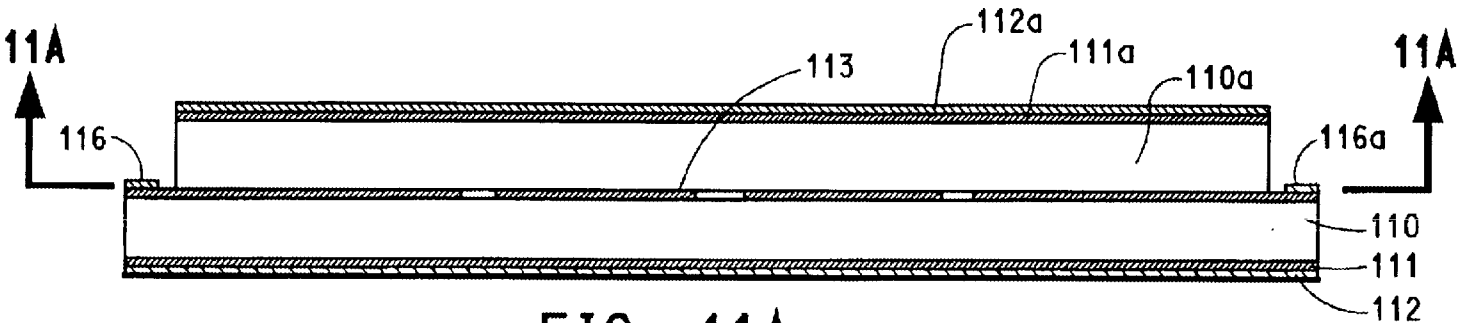
FIG. 11 shows an embodiment of the present invention of a strip line 4-pole HTS mini-filter with self-resonant rectangular spiral resonators with rounded corners, center tuning pads, and parallel lines input/output coupling circuits. FIG.

FIG. 11 shows an example of a 4-pole HTS filter in the strip line form with four rectangular self-resonant spiral resonators with rounded corners as its frequency selecting element. FIG. 11*a* is a side view of the filter and FIG. 11*b* is a view as seen along lines and arrows A—A of FIG. 11*a*. Numeral 110 is a dielectric substrate with a front side and a back side. The HTS filter circuit 113 is disposed on the front side of substrate 110 as seen in FIG. 11*b*. As shown in FIG. 11*a*, a first blank HTS film 111 is disposed on the back side of substrate 110 serving as one of the two ground planes for the strip line, a first gold film 112 is disposed on top of first blank HTS film 111 serving as the contact to the filter's case 118, shown in FIGS. 11*a* and 11*b*. Numeral 110*a* is a dielectric superstrate with a front side and a back side. As shown in FIG. 11*a*, a second blank HTS film 111*a* is disposed on the back side of superstrate 110*a* serving as one of the two ground planes for the strip line, a second gold film 112*a* is disposed on top of second blank HTS film 111*a* serving as the contact to the filter's case 118, shown in FIG. 11*a*. As is also shown in FIG. 11*a*, superstrate 110*a* is smaller in size than substrate 110, whereby the first end (e.g., microstrip line 115 and gold contact pad 116) of the input coupling circuit and the first end (e.g., microstrip line 115*a* and gold contact pad 116*a*) of the output coupling circuit are each located outside the dimensions of superstrate 110*a*, that is, they are not covered by superstrate 110*a*. Although not shown, it is understood that the mirror image of HTS filter circuit 113 could also be disposed on the front side of superstrate 110*a* and the two mirror image circuits aligned. As shown in FIG. 11*b*, the input and output strip lines 114 and 114*a* are extended into broader microstrip lines 115 and 115*a*, respectively, on the substrate 110. Gold contact pads 116 and 116*a* are disposed on microstrip lines 115 and 115*a*, respectively (also seen in FIG. 11*a*), providing the connections to the filter input and output connectors 117 and 117*a*, respectively, shown in FIGS. 11*a* and 11*b*. The line width of output strip lines 114 and 114*a*, and microstrip lines 115 and 115*a*, are selected in such a way to achieve the impedance matching at the input and the output.

In all of the embodiments described above, it is preferred that the high temperature superconductor is selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$. It is also preferred that the substrate and superstrate are independently selected from the group consisting of $LaAlO_3$, MgO, $LiNbO_3$, sapphire and quartz.

EXAMPLE

Figure 12:
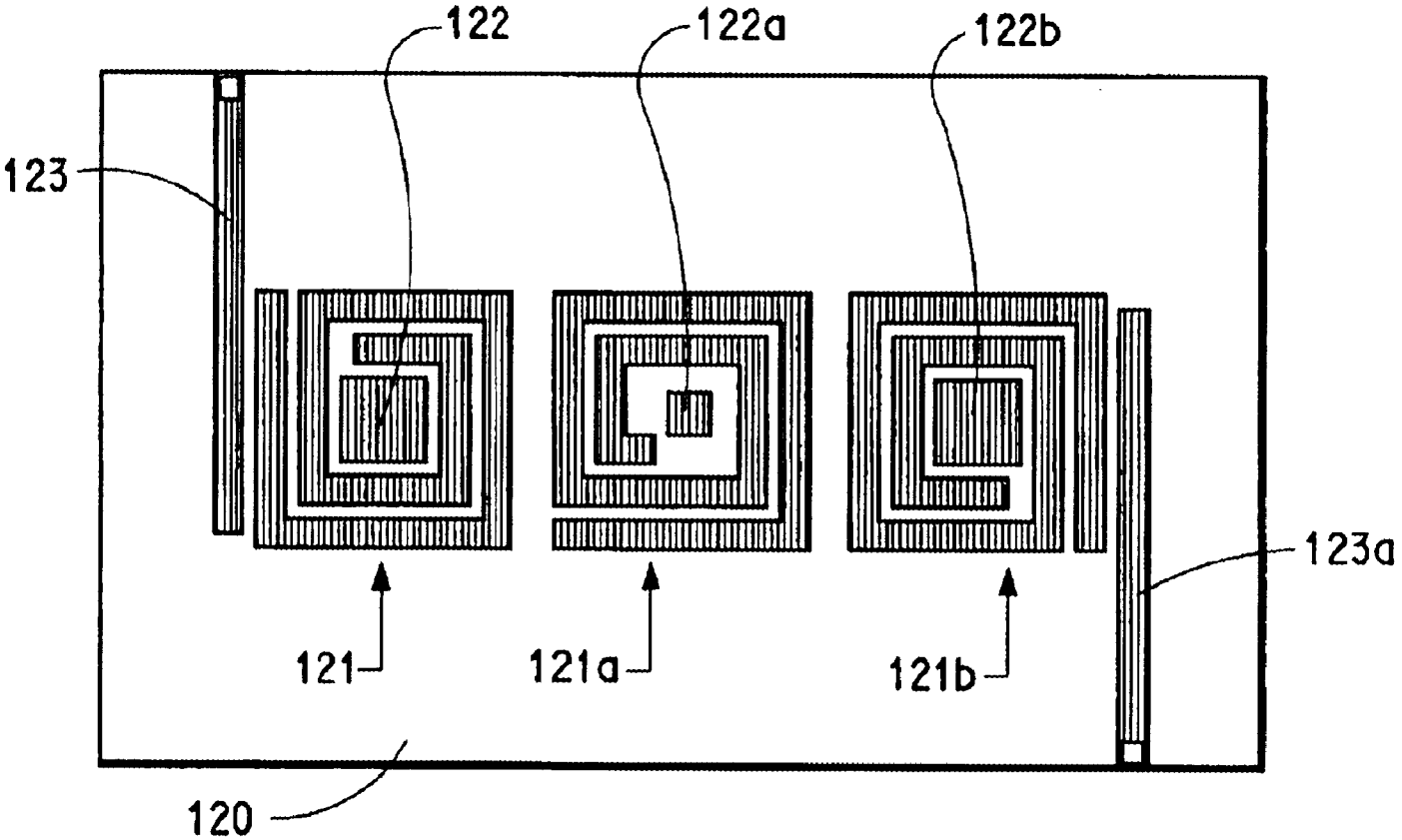
FIG. 12 shows the layout of a prototype 3-pole 0.16 GHz bandwidth centered at 5.94 GHz microstrip line HTS mini-filter with three self-resonant rectangular spiral resonators.
Figure 13A:
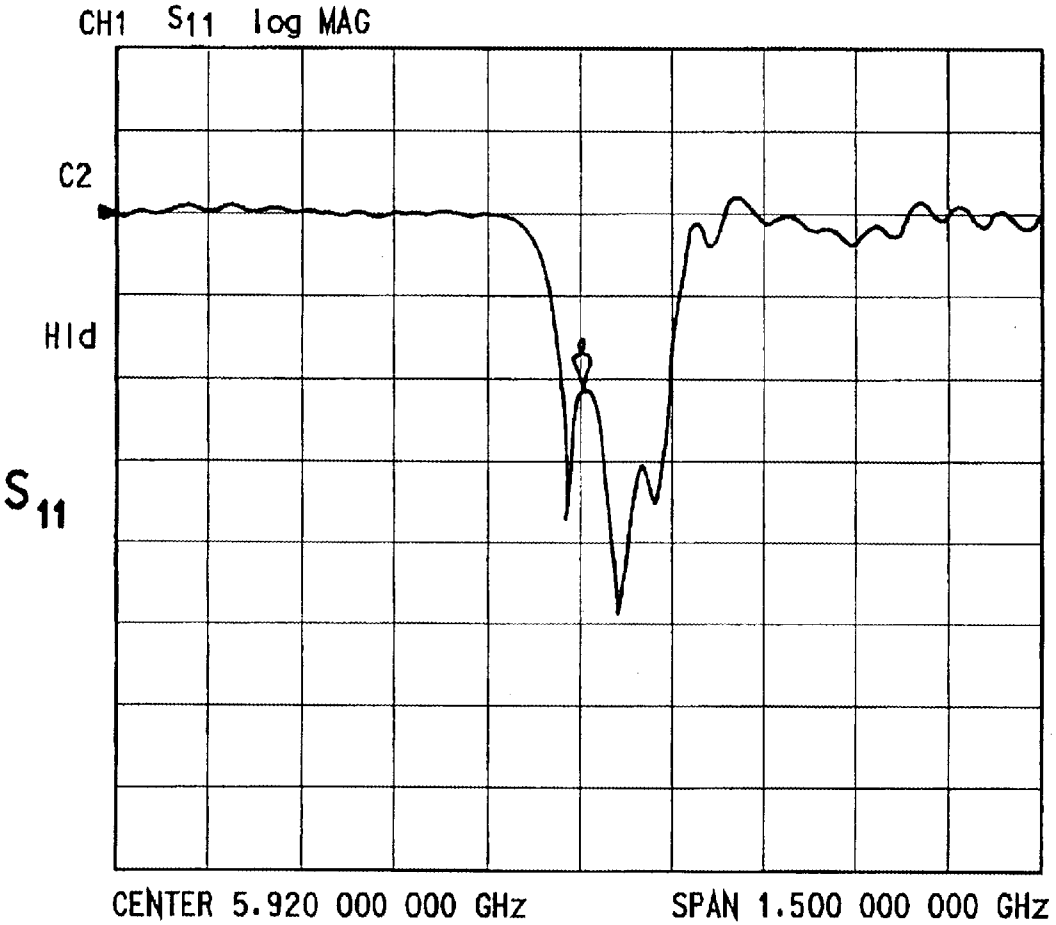
FIG. 13*a* shows $S_{11}$ versus frequency data.
Figure 13B:
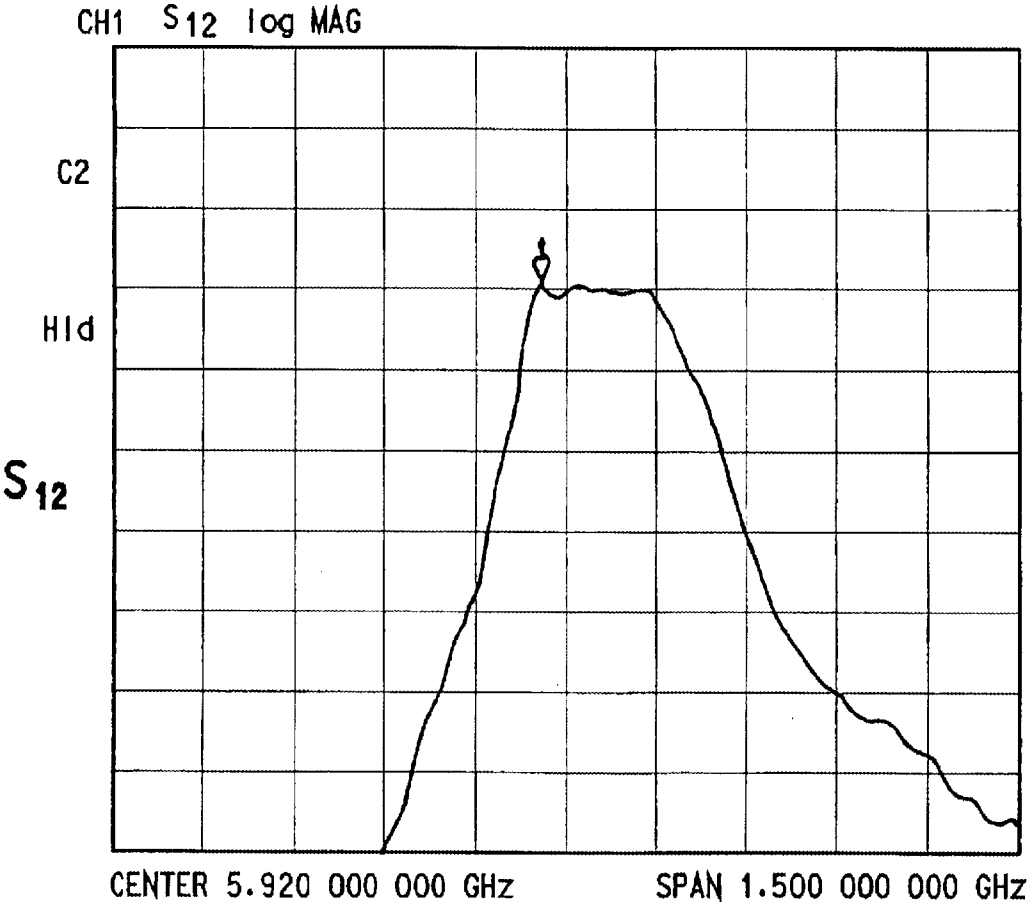
FIG. 13*b* shows $S_{12}$ versus frequency data.
Figure 13C:
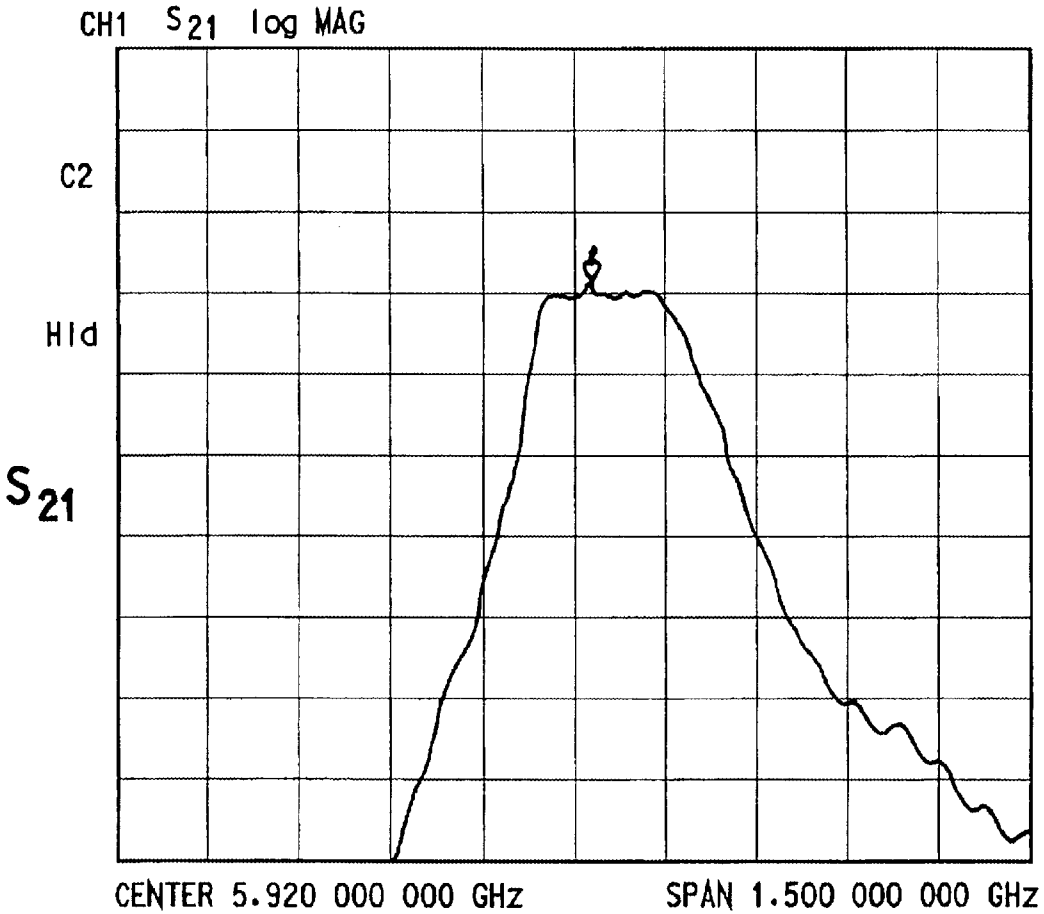
FIG. 13*c* shows $S_{21}$ versus frequency data.
Figure 13D:
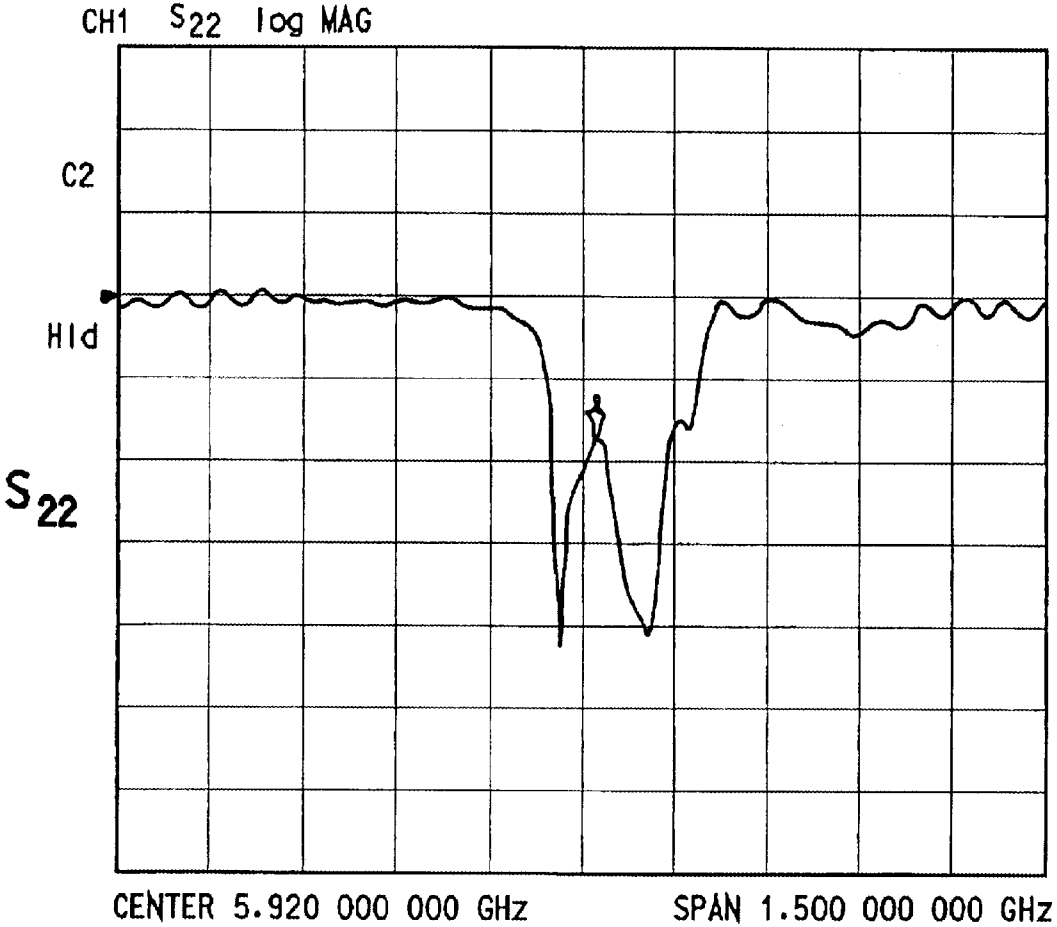
FIG. 13*d* shows $S_{22}$ versus frequency data.

A mini-filter having the circuit layout shown in FIG. 12 was prepared. It is a 3-pole 0.16 GHz bandwidth centered at 5.94 GHz mini filter in the microstrip line form. It consists of three rectangular self-resonant spiral resonators, 121, 121*a*, 121*b*, each having a tuning pad at the center, 122, 122*a*, 122*b*, parallel lines input and output coupling circuits, 123, 123*a*. The substrate 120 is made of $LaAlO_3$ with dimensions of 5.250 mm×3.000 mm×0.508 mm. The HTS thin film is $Tl_2Ba_2CaCu_2O_8$. The filter was fabricated, and tested at 77 K. The measured S-parameter data are shown in FIG. 13, in which FIG. 13*a* shows $S_{11}$ versus frequency data, FIG. 13*b* shows $S_{12}$ versus frequency data, FIG. 13*c* shows $S_{21}$ versus frequency data, FIG. 13*d* shows $S_{22}$ versus frequency data. $S_{11}$ is the magnitude of the reflection coefficient from the input port; $S_{21}$ is the magnitude of the transmitting coefficient from the input port to the output port; $S_{22}$ is the magnitude of the reflection coefficient from the output port; and $S_{12}$ is the magnitude of the transmitting coefficient from the output port to the input port. The results show that the center frequency is about 5.95 GHz and the band width is about 170 MHz. The return loss is about 12 dB as measured by $S_{11}$ (see FIG. 13*a*, wherein the scale along the ordinate axis is 5 dB per division), and 8 dB as measured by $S_{22}$ (see FIG. 13*d*, same scale). Reference to FIG. 13*b* or 13*c* shows there is essentially zero insertion loss. The measured data were in agreement with the computer simulated data very well, the center frequency difference was less than 0.1%.

Figure 14:
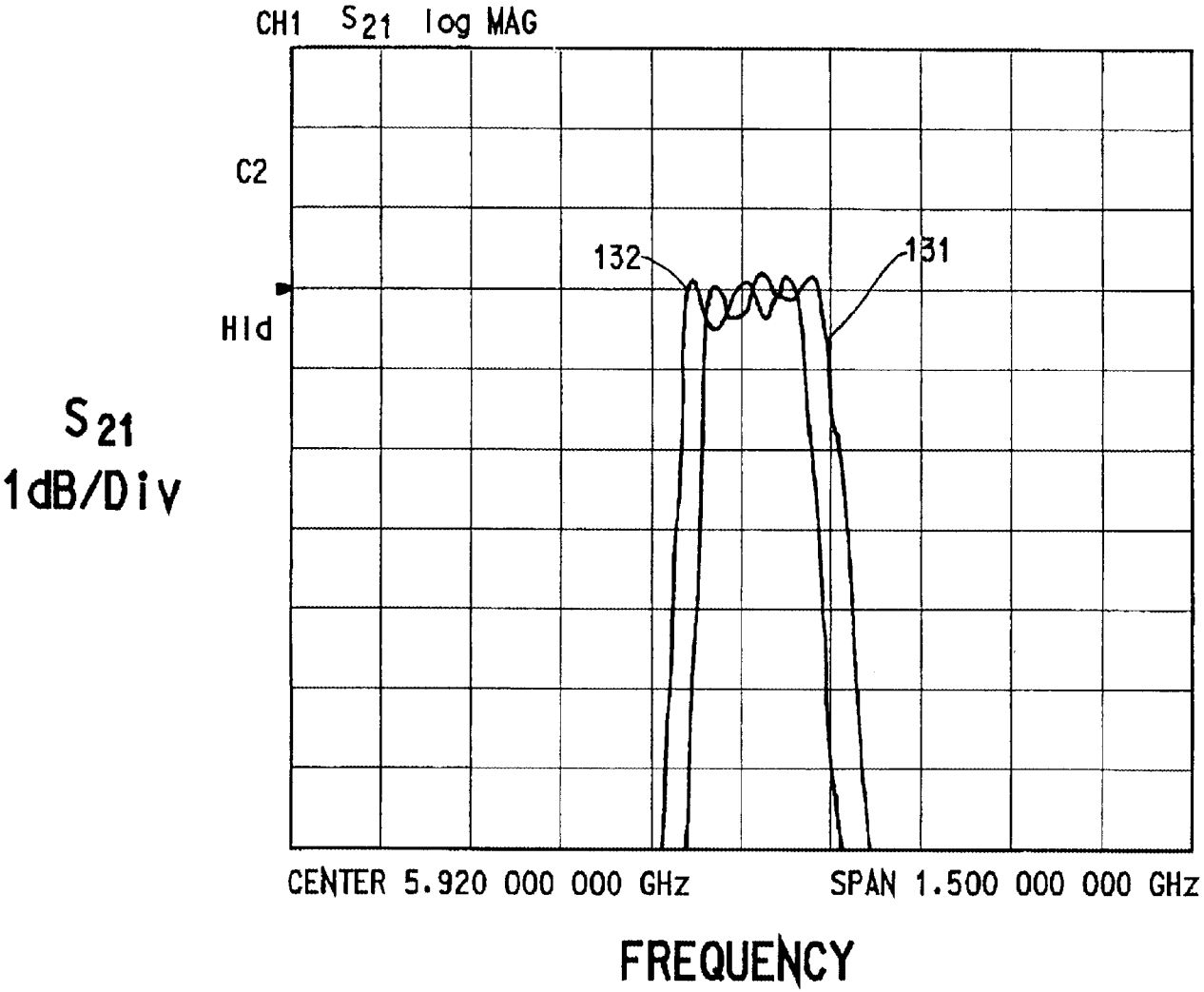
FIG. 14 shows the measured $S_{21}$ versus frequency data of the mini-filter shown in FIG. 12 to show the frequency shift caused by changing the medium of the space above the circuit.

The mini-filter was also tested under two different conditions. That is, it was tested in the air with a relative dielectric constant of approximately 1.00, and also was tested in liquid nitrogen with a relative dielectric constant of approximately 1.46. FIG. 14 shows the $S_{21}$ versus frequency data, in which 131 is for the air data and 132 is for the liquid nitrogen data. The results indicate a frequency shift of only 0.04 GHz corresponding to 0.67% of the center frequency. The very small frequency shift is an indirect indication of most electromagnetic fields confinement beneath the spiral resonators.

Figure 15:
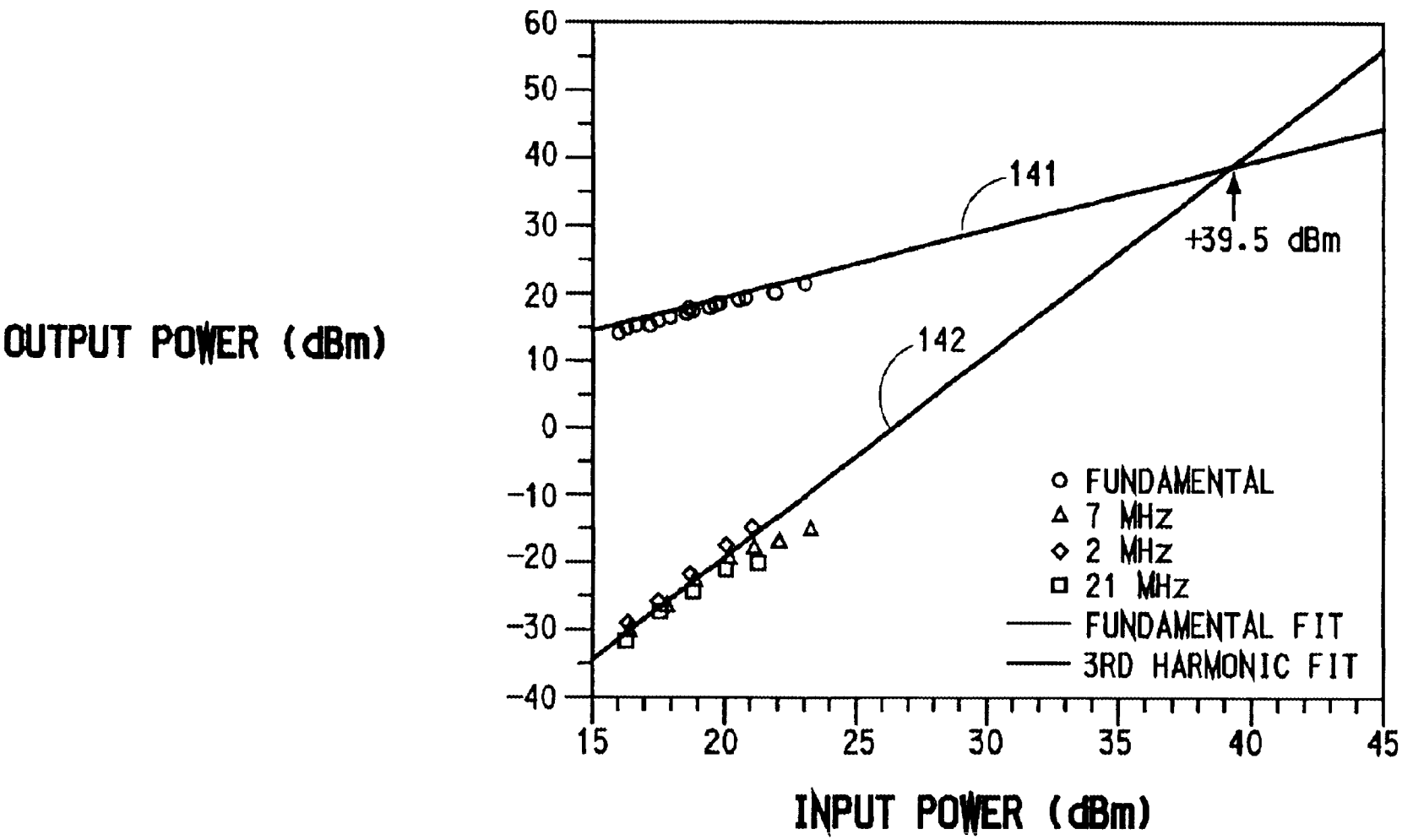
FIG. 15 shows the measured third order intermodulation data of the mini-filter shown in FIG. 12 to show its nonlinearity behavior.

The filter was also tested under power from 0.01 watt up to 0.2 watt cw rf power without measurable changes in its $S_{21}$. The Third Order Intercept (TOI) test is an indication of the non-linearity of the filter. The higher the intercept, the higher the power handling capability of the filter. Test data are shown in FIG. 15 in a log—log scale, in which line 141 is the best fit straight line with a slope of 1 for the sum of two fundamental frequencies, line 142 is the best fit straight line with a slope of 3 for the third order intermadulation. The intercept of these two lines gives a TOI of 39.5 dBm, which is a high value and indicates the power handling capability of the filter. Both the power and the TOI test data are in line with similar conventional HTS filters with the same line width and ten times larger size. These test results confirmed that the one order of magnitude reduction of size does not degrade the mini-filter's performance compared to the conventional design.

What is claimed is:

1. A high temperature superconductor mini-filter comprising:

(a) a substrate having a front side and a back side;

(b) at least two self-resonant spiral resonators in intimate contact with the front side of the substrate, each of said resonators independently comprising a high temperature superconductor line oriented in a spiral fashion (i) such that adjacent lines are spaced from each other by a gap distance which is less than the line width; and (ii) so as to provide a central opening within the spiral resonator, the dimensions of which are approximately equal to the gap distance;

(c) at least one inter-resonator coupling;

(d) an input coupling circuit comprising a transmission line with a first end thereof connected to an input connector of the filter and a second end thereof coupled to a first one of the at least two self-resonant spiral resonators;

(e) an output coupling circuit comprising a transmission line with a first end thereof connected to an output connector of the filter and a second end thereof coupled to a last one of the at least two self-resonant spiral resonators;

(f) a blank high temperature superconductor film disposed on the back side of the substrate as a ground plane;

(g) a conductive film disposed on the blank high temperature superconductor film as the contact to a case for said mini-filter;

(h) a superstrate having a front side and a back side, wherein the front side of the superstrate is positioned in intimate contact with the at least two resonators disposed on the front side of the substrate;

(i) a second blank high temperature superconductor film disposed at the back side of the superstrate as a ground plane; and (j) a second conductive film disposed on the surface of said second high temperature superconductor film as a contact to said case for said mini-filter wherein the superstrate is smaller in size than the substrate; and wherein the first end of the input coupling circuit and the first end of the output coupling circuit are each located outside the dimensions of the superstrate.

2. The mini-filter of claim 1 wherein a substrate is selected from the group consisting of $LaAlO_3$, MgO, $LiNbO_3$, sapphire and quartz.

3. The mini-filter of claim 1 wherein said mini-filter contains an odd number of self-resonant spiral resonators with one resonator being centrally located and wherein the centrally located resonator comprises a double spiral form resonator comprising two connected spiral lines with a 180-degree rotational symmetry.

4. The mini-filter of claim 1 wherein a self-resonant spiral resonator has a shape selected from the group consisting of rectangular, rectangular with rounded corners, polygon and circular.

5. The mini-filter of claim 1 wherein a conductive tuning pad is disposed in the central opening of a self-resonant spiral resonator.

6. The mini-filter of claim 1 wherein a self-resonant spiral resonator is selected from the group consisting of $YBa_2Cu_3O_7$, $Tl_2Ba_2CaCu_2O_8$, $TlBa_2Ca_2Cu_3O_9$, (TlPb) $Sr_2CaCu_2O_7$ and (TlPb)$Sr_2Ca_2Cu_3O_9$.

7. The mini-filter of claim 1 wherein a high temperature superconductor film is selected from the group consisting of $YBa_2Cu_3O_7$, $Tl_2Ba_2CaCu_2O_8$, $TlBa_2Ca_2Cu_3O_9$, (TlPb) $Sr_2CaCu_2O_7$ and (TlPb)$Sr_2Ca_2Cu_3O_9$.

8. A high temperature superconductor mini-multiplexer comprising:

(a) at least two mini-filters, each mini-filter having a frequency band which is different from and does not overlap with the frequency bands of each other mini-filter;

(b) a distribution network with one common port as an input for the mini-multiplexer and multiple distributing ports, wherein a respective distributing port is connected to an input of a corresponding mini-filter; and (c) a multiple of output lines, wherein a respective output line is connected to an output of a corresponding mini-filter;

wherein each of said at least two mini-filters comprises:

(d) a substrate having a front side and a back side;

(e) at least two self-resonant spiral resonators in intimate contact with the front side of the substrate, each of said resonators independently comprising a high temperature superconductor line oriented in a spiral fashion (i) such that adjacent lines are spaced from each other by a gap distance which is less than the line width; and (ii) so as to provide a central opening within the spiral resonator, the dimensions of which are approximately equal to the gap distance;

(f) at least one inter-resonator coupling;

(g) an input coupling circuit comprising a transmission line with a first end thereof connected to said respective distributing port and a second end thereof coupled to a first one of the at least two self-resonant spiral resonators;

(h) an output coupling circuit comprising a transmission line with a first end thereof connected to said respective output line and a second end thereof coupled to a last one of the at least two self-resonant spiral resonators;

(i) a blank high temperature superconductor film disposed on the back side of the substrate as a ground plane; and (j) a conductive film disposed on the blank high temperature superconductor film as the contact to a case for said mini-filter.

9. The mini-multiplexer of claim 8 wherein one or more of said mini-filters contains an odd number of self-resonant spiral resonators with one resonator being centrally located and wherein the centrally located resonator comprises a double spiral form resonator comprising two connected spiral lines with a 180-degree rotational symmetry.

10. The mini-multiplexer of claim 8 wherein all said self-resonant spiral resonators have an identical configuration selected from the group consisting of rectangles, rectangles with rounded corners, polygons and circles.

11. The mini-multiplexer of claim 8 wherein the input and output coupling circuits are in the parallel lines form and each comprises:

(a) a microstrip line, (b) a gap between each said microstrip line and the first resonator for the input coupling circuit, or the last resonator for the output coupling circuit, of the said mini-filter, and (c) a gold pad at the end the microstrip line.

12. The mini-multiplexer of claim 8 wherein one or more of said mini-filters further comprises:

(k) a superstrate having a front side and a back side, wherein the front side of the superstrate is positioned in intimate contact with the at least two resonators disposed on the front side of the substrate;

(l) a second blank high temperature superconductor film disposed at the back side of the superstrate as a ground plane; and (m) a second conductive film disposed on the surface of said second high temperature superconductor film as a contact to said case for said mini-filter.

13. The mini-multiplexer of claim 12 wherein the respective superstrate is smaller in size than the corresponding substrate; and wherein the first end of the input coupling circuit and the first end of the output coupling circuit are each located outside the dimensions of the corresponding superstrate.

14. The mini-multiplexer of claim 12 wherein each high temperature superconductor film is selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$.

15. The mini-multiplexer of claim 12 wherein each substrate and superstrate are selected from the group consisting of $LaAlO_3$, MgO, $LiNbO_3$, sapphire and quartz.

16. The mini-multiplexer of claim 12 wherein a respective conductive tuning pad is disposed in the central opening of one or more of said self-resonant spiral resonators.

17. The mini-multiplexer of claim 12 wherein each self-resonant spiral resonator is selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$.

18. The mini-multiplexer of claim 8 wherein each substrate is selected from the group consisting of $LaAlO_3$, MgO, $LiNbO_3$, sapphire and quartz.

19. The mini-multiplexer of claim 8 wherein each high temperature superconductor film is selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$.

20. The mini-multiplexer of claim 8 wherein each self-resonant spiral resonator is selected from the group consisting of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$.

21. The mini-multiplexer of claim 8 wherein each of said self-resonant spiral resonators has a shape selected from the group consisting of rectangular, rectangular with rounded corners, polygon and circular.

22. The mini-multiplexer of claim 8 wherein a respective conductive tuning pad is disposed in the central opening of one or more of said self-resonant spiral resonators.

* * * * *